US011452667B2

(12) United States Patent
Tan et al.

(10) Patent No.: US 11,452,667 B2
(45) Date of Patent: Sep. 27, 2022

(54) METHOD OF DRIVING A MASSAGE CHAIR

(71) Applicant: OSIM INTERNATIONAL LTD, Singapore (SG)

(72) Inventors: Kia Tong Tan, Singapore (SG); Tsuyoshi Sato, Kanagawa (JP)

(73) Assignee: OSIM International Ltd., Singapore (SG)

( * ) Notice: Subject to any disclaimer, the term of this patent is extended or adjusted under 35 U.S.C. 154(b) by 1072 days.

(21) Appl. No.: 14/895,053

(22) PCT Filed: Jun. 3, 2013

(86) PCT No.: PCT/SG2013/000233

§ 371 (c)(1),
(2) Date: Dec. 1, 2015

(87) PCT Pub. No.: WO2014/196923

PCT Pub. Date: Dec. 11, 2014

(65) Prior Publication Data

US 2016/0113835 A1 Apr. 28, 2016

(51) Int. Cl.
*A61H 15/00* (2006.01)
*A47C 7/40* (2006.01)
(Continued)

(52) U.S. Cl.
CPC ..... *A61H 15/0078* (2013.01); *A47C 7/40* (2013.01); *A61H 7/007* (2013.01); *A61H 9/0078* (2013.01);
(Continued)

(58) Field of Classification Search
CPC .. A61H 15/0078; A61H 7/007; A61H 23/006; A61H 2201/1669;
(Continued)

(56) References Cited

U.S. PATENT DOCUMENTS 6,224,563 B1 * 5/2001 Nonoue ..... A61H 15/0078 601/100
2002/0138023 A1 * 9/2002 Kume ..... A61H 15/0078 601/99
(Continued)

FOREIGN PATENT DOCUMENTS

CN 101002711 A 7/2007
JP H07213572 A 8/1995
(Continued)

OTHER PUBLICATIONS

International Search Report, PCT/SG2013/000233, dated Sep. 6, 2013, 4 pages.
(Continued)

*Primary Examiner* — Timothy A Stanis
(74) *Attorney, Agent, or Firm* — Baker & McKenzie LLP

(57) ABSTRACT

Methods of driving a massage chair are described for dispensing effective massage to reduce stress and relieve pain in an effective manner. The massage chair includes a backrest, a seat, two massage arms assembled with the backrest and having at least two contact members, a plurality of bottom airbags disposed in the seat, and a plurality of lateral airbags disposed at a left and a right side of the seat. The method includes defining a coordinate reference including a lengthwise axis extending along a length of the backrest, a transversal axis extending from a left toward a right side of the backrest, and a front-rear axis extending from a front toward a rear of the backrest, and driving the massage arms to perform certain sequences of massage actions to provide relief in the neck and shoulder areas, the lower back, and thigh and hip.

12 Claims, 27 Drawing Sheets

(51) Int. Cl.
*A61H 9/00* (2006.01)
*A61H 23/00* (2006.01)
*A61H 7/00* (2006.01)

(52) U.S. Cl.
CPC ... *A61H 23/006* (2013.01); *A61H 2015/0014* (2013.01); *A61H 2201/0149* (2013.01); *A61H 2201/1215* (2013.01); *A61H 2201/149* (2013.01); *A61H 2201/164* (2013.01); *A61H 2201/1623* (2013.01); *A61H 2201/1661* (2013.01); *A61H 2201/1669* (2013.01); *A61H 2201/1671* (2013.01); *A61H 2201/1676* (2013.01); *A61H 2201/5002* (2013.01); *A61H 2201/5005* (2013.01); *A61H 2201/5035* (2013.01); *A61H 2201/5038* (2013.01); *A61H 2201/5066* (2013.01)

(58) Field of Classification Search
CPC .... A61H 2201/5053; A61H 2201/1676; A61H 2201/1623; A61H 2201/1215; A61H 2201/5038
See application file for complete search history.

(56) References Cited

U.S. PATENT DOCUMENTS

2004/0122343 A1* 6/2004 Mori ..... A61H 15/0078 601/99
2004/0158181 A1* 8/2004 Watanabe ..... A61H 7/007 601/99
2005/0192520 A1* 9/2005 Morita ..... A61H 7/00 601/99
2007/0167887 A1 7/2007 Tsukada et al.
2010/0117427 A1* 5/2010 Fukuyama ..... A61H 9/0078 297/338
2011/0015554 A1* 1/2011 Morikawa ..... A61H 1/0244 601/84
2011/0275968 A1* 11/2011 Liu ..... A61H 7/007 601/134
2012/0215143 A1* 8/2012 Inada ..... A61H 1/003 601/112

FOREIGN PATENT DOCUMENTS

JP 2001029416 A 2/2001
JP 2002369855 A 12/2002
JP 2004-216029 A 8/2004
JP 2005-192603 A 7/2005
JP 2007215555 A 8/2007
JP 2010017489 A 1/2010
JP 2012090675 A 5/2012
JP 2013070857 A 4/2013
SG 189446 A1 5/2013
TW 200716078 A 5/2007

OTHER PUBLICATIONS

International Preliminary Report on Patentability, PCT/SG2013/000233, dated Jul. 28, 2015, 4 pages.
Chinese Office Action, CN Application No. 201380077180.7, dated Nov. 18, 2016, 20 pages.
Chinese Office Action, CN Application No. 201380077180.7, dated Jun. 23, 2017, 19 pages.
Office Action from the Japanese Patent Office (JPO) in the corresponding Japanese Application No. 2016518304 filed on Jun. 3, 2013.
Taiwan Office Action, TW Application No. 103119101, dated Jan. 14, 2016, 15 pages (list of prior art cited located on p. 15 of action).
Office Action dated Mar. 2, 2021 in corresponding Chinese Patent Application No. 201910933892.2.

* cited by examiner

202

METHOD OF DRIVING A MASSAGE CHAIR

CROSS-REFERENCE TO RELATED APPLICATION(S)

This patent application is a national phase filing under section 371 of PCT/SG2013/000233, filed Jun. 3, 2013, which is incorporated herein by reference in its entirety.

BACKGROUND

1. Field of the Invention

The present inventions generally relate to massage chairs, and more particularly to methods of driving a massage chair.

2. Description of the Related Art

Massage apparatuses currently available on the market include massage chairs equipped with a massage member capable of applying diverse types of massage actions on a user's body. According to the needs, a user may select a massage program corresponding to a predetermined combination of movement and pressure actions of the massage member for producing certain desirable relaxing effects. However, the application of the existing programs may require a relatively long massage time.

Therefore, there is a need for massage apparatuses that can address at least the foregoing issues.

SUMMARY

The present application describes methods of driving a massage chair for dispensing effective massage to reduce stress and relieve pain in an effective manner. The massage chair includes a backrest, a seat, two massage arms assembled with the backrest and having at least two contact members, a plurality of bottom airbags disposed in the seat, and a plurality of lateral airbags disposed at a left and a right side of the seat. In one embodiment, the method includes defining a coordinate system including a lengthwise axis extending along a length of the backrest, a transversal axis extending from a left toward a right side of the backrest, and a front-rear axis extending from a front toward a rear of the backrest, and driving the massage arms to perform a first sequence of massage actions. The first sequence of massage actions includes moving the massage arms along the lengthwise axis to a first position so that the two contact members are placed adjacent to an upper shoulder area. While the massage arms are in the first position, the massage arms are actuated so as to cause the two contact members to move forward along the front-rear axis and then to apply a single kneading action. The massage arms then are moved downward along the lengthwise axis from the first position to a second position, and the bottom airbags are concurrently inflated. While the massage arms are in the second position, the massage arms are then actuated so as to cause the two contact members to apply another single kneading action.

In certain embodiment, the method further includes driving the massage arms to perform a second sequence of massage actions. The second sequence of massage actions includes moving the massage arms along the lengthwise axis to a third position so that the contact members are placed adjacent to the upper shoulder area, wherein the two contact members in the third position are spaced apart from each other by a first distance along the transversal axis. While the massage arms are in the third position, the bottom airbags in the seat are inflated, and the massage arms are actuated to cause a forward displacement of the contact members along the front-rear axis for applying a pressure for a first time duration, and to apply a tapping action after the lapse of the first time duration. The massage arms are then moved downward along the lengthwise axis from the third position to a fourth position, and are actuated so that the contact members in the fourth position are spaced apart from each other by a second distance along the transversal axis that is greater than the first distance. While the massage arms are in the fourth position, a pressure is applied through the contact members for a second time duration, and the massage arms are actuated to apply another tapping action after the lapse of the second time duration.

The method further includes driving the massage arms to perform a third sequence of massage actions. The third sequence includes moving the massage arms along the lengthwise axis to a third position so that the contact members are placed adjacent to a lower waist area. While the massage arms are in the third position, the massage arms are actuated to cause the contact members to repeat two or more times a push and hold sequence including: moving the contact members forward along the front-rear axis for applying a pressure, and holding the pressure for a time duration.

In some embodiment, the method further includes driving the massage arms to perform a fourth sequence of massage actions. The fourth sequence includes inflating the lateral airbags for a first time duration, and after the lapse of the first time duration, inflating the bottom airbags for a second time duration.

In some other embodiments, the method also includes driving the massage arms to perform a fifth sequence of massage actions. The fifth sequence includes moving the massage arms along the lengthwise axis to a third position so that the contact members are placed adjacent to an upper neck area. While the massage arms are in the third position, the massage arms are actuated to cause a forward displacement of the contact members along the front-rear axis. The massage arms are then moved along the lengthwise axis from the third position downward to a fourth position while keeping the forward displacement of the contact members.

DETAILED DESCRIPTION OF THE EMBODIMENTS

Figure 1:
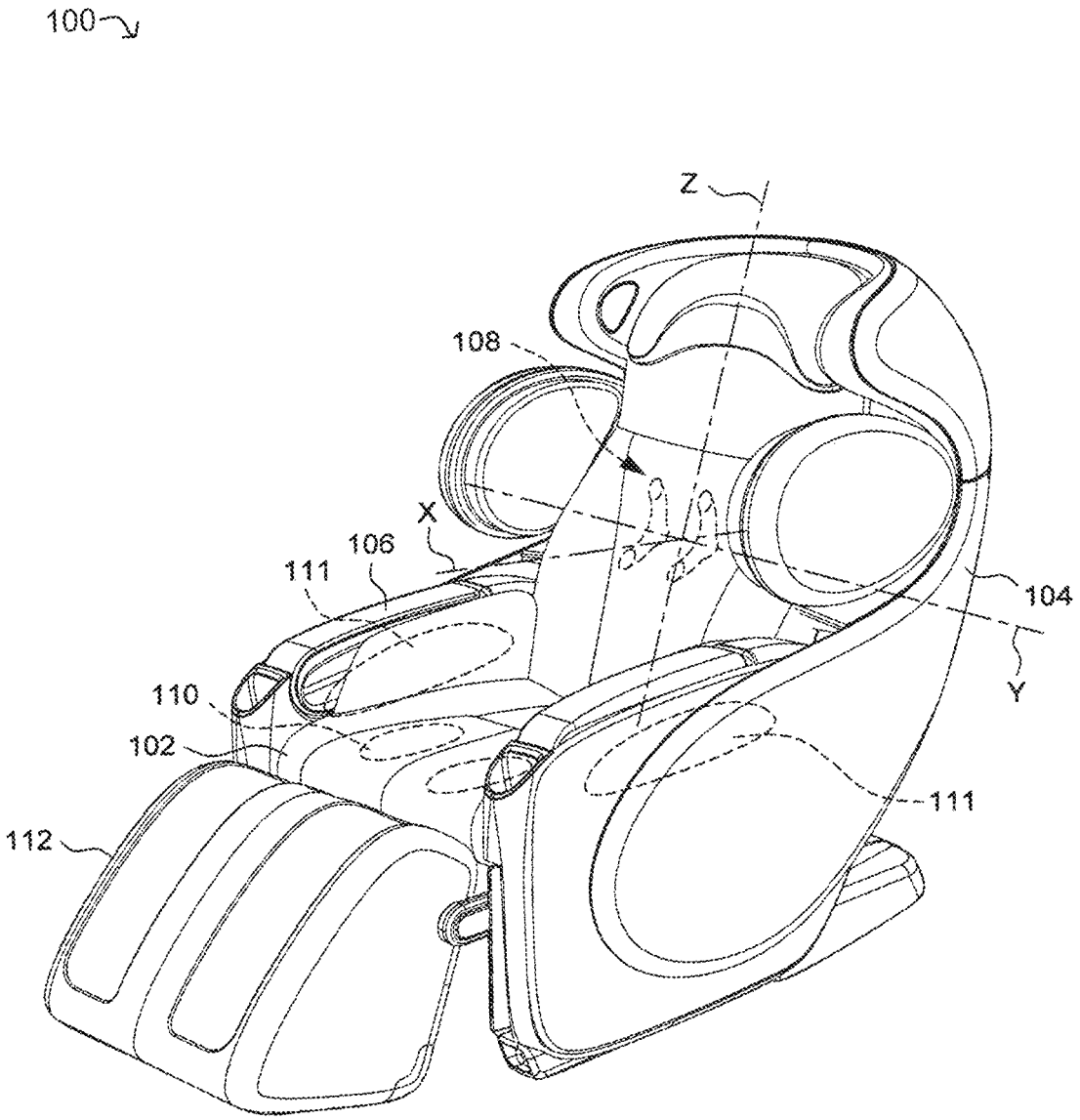
FIG. 1 is a schematic view illustrating an embodiment of a massage chair.

FIG. 1 is a schematic view illustrating an embodiment of a massage chair 100. The massage chair 100 can include a seat 102, a backrest 104 assembled with the seat 102 at a rear thereof, and left and right armrests 106 disposed at the left and right sides of the seat 102. The seat 102 can provide support for a user in a sitting position. The backrest 104 can be pivotally connected with the seat 102, and can be adjustable in inclination. The backrest 104 can include a back massaging module 108 operable to apply kneading and/or tapping massages along the back of a user from the shoulders to the waist. A plurality of bottom airbags 110 can be disposed inside the seat 102, and lateral airbags 111 can be provided at the left and right flanks of the seat 102. The airbags 110 and 111 can inflate for pushing the user's body upward and/or applying pressure on the left and right thighs of the user's body.

As shown in FIG. 1, the massage chair 100 can further include a foot massage unit 112 disposed on a floor at an underside of the seat 102. The foot massage unit 112 is operable to apply massage to foot portions of the user.

Figure 2:
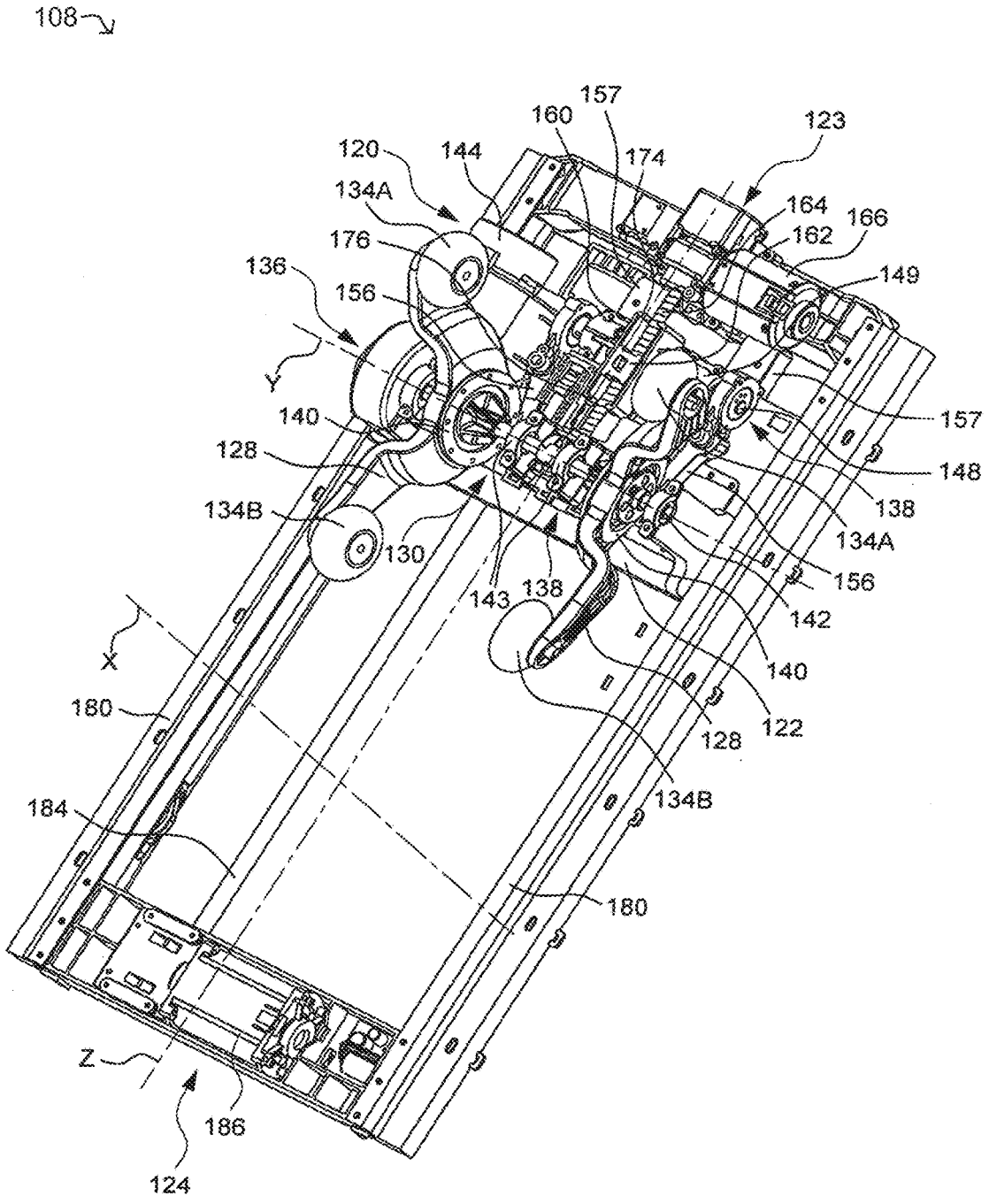
FIGS. 2 and 3 are schematic views illustrating the construction of a back massaging module provided in a backrest of the massage chair.
Figure 3:
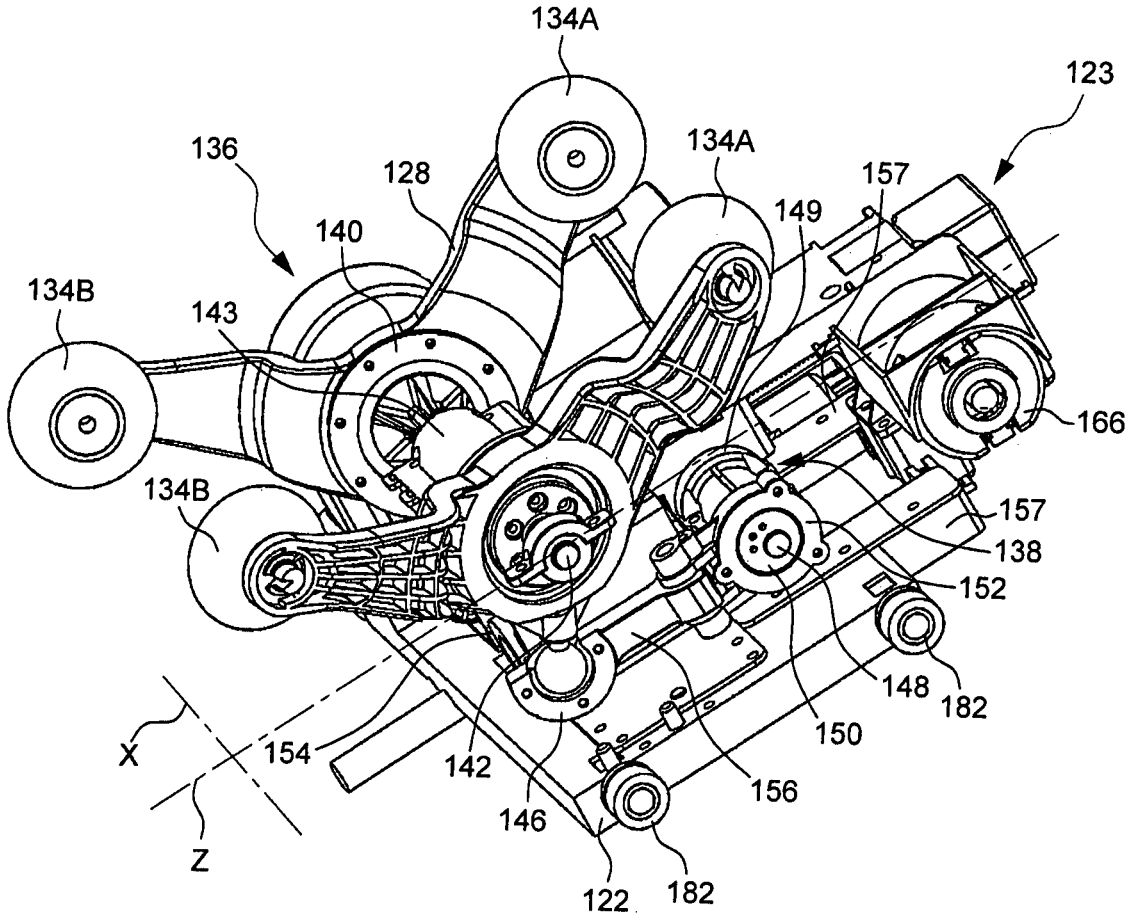

In conjunction with FIG. 1, FIGS. 2 and 3 are schematic views illustrating the construction of the back massaging module 108. The back massaging module 108 can be movable vertically along a height direction of the backrest 104, which is also referred herein as a lengthwise axis Z. The back massaging module 108 can include a massage dispensing mechanism 120, a platform 122 for supporting the massage dispensing mechanism 120, and a forward positioning mechanism 123. The platform 122 can be operatively connected with a vertical driving unit 124 operable to drive unison motion of the platform 122 and the massage dispensing mechanism 120 along the lengthwise axis Z. The forward positioning mechanism 123 can be operable to modify an amount of displacement of an upper end of the massage dispensing mechanism 120 along a front-rear axis X extending from a front to a rear of the backrest 104. The massage dispensing mechanism 120 can be operable to apply different types of massage actions on a user's body, such as pressure actions, kneading actions, tapping actions, and up and down rolling actions.

In one embodiment, the massage dispensing mechanism 120 can include a left and a right massage arm 128, and a driving unit 130 operable to drive motion of the massage arms 128. The massage arms 128 can be transversally spaced apart from each other, and can rotate about a transversal axis Y extending horizontally from a left to a right side of the backrest 104. Each of the massage arms 128 can have a boomerang-like shape with upper and lower ends respectively assembled with contact members 134A and 134B. Each of the contact members 134A and 134B can be formed as a roller or ball made of a resin or hard rubber material.

The driving unit 130 can include a kneading drive portion 136 and a tapping drive portion 138. The kneading drive portion 136 can drive motion of the massage arms 128 so as to cause the contact members 134A and/or 134B to apply a kneading action. The kneading action can include a combination of pressing and stretching actions applied on the tissue. The tapping drive portion 138 can drive motion of the massage arms 128 so as to cause the contact members 134A and/or 134B to apply tapping massage on a desired region of the user's body.

The kneading drive portion 136 can include two inclined rotating members 140 respectively embedded at bent central regions of the two massage arms 128, a rotary shaft 142 passing through the rotating members 140, a kneading motor 144 for driving rotation of the rotary shaft 142, and two swing preventive mechanisms 146 at the rear of the central regions of the massage arms 128.

The rotary shaft 142 can be supported by a bearing 143 affixed with the platform 122. The rotary shaft 142 can include two inclined boss portions spaced apart from each other about which the rotating members 140 can be rotatably fitted via bearings. Accordingly, as the rotary shaft 142 is driven in rotation by the kneading motor 144, the two rotating members 140 can swing and wobble about the transversal axis Y defined by the rotary shaft 142, which results in a periodic swing motion of the massage arms 128 and contact members 134A and 134B.

In one embodiment, the inclination of the rotating member 140 can be maintained with a phase difference of 180° with respect to the rotary shaft 142 between the two massage arms 128. When the rotary shaft 142 is driven in rotation by the kneading motor 144, the upper contact members 134A of the massage arms 128 can swing toward and away from each other in an alternated manner, whereas the lower contact members 134B of the massage arms 128 can alternately swing toward and away from each other opposite to the movement of the upper contact members 134A (i.e., the lower contact members 134B move toward each other when the upper contact members 134A move away from each other, and vice versa). The aforementioned motion can produce kneading massage actions.

Referring to FIG. 3, each of the swing preventive mechanisms 146 can be formed by a ball joint or universal coupling. The swing preventive mechanisms 146 can restrain the massage arms 128 to move dependently with the rotation of the rotary shaft 142, while permitting displacements of the massage arms 128 in a freely manner along the front-rear axis X, and in a limited range along the lengthwise axis Z.

Figure 4:
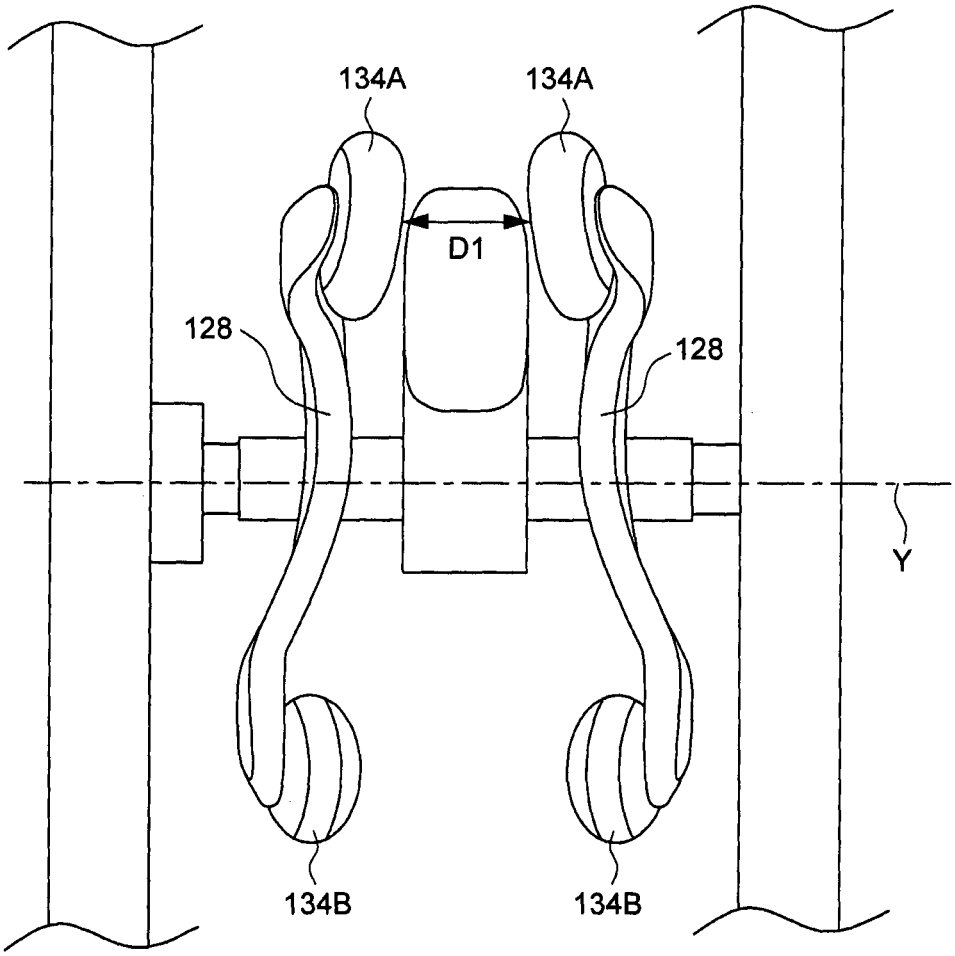
FIG. 4 is a schematic view illustrating massage arms of the back massaging module having upper contact members in a narrow state.
Figure 5:
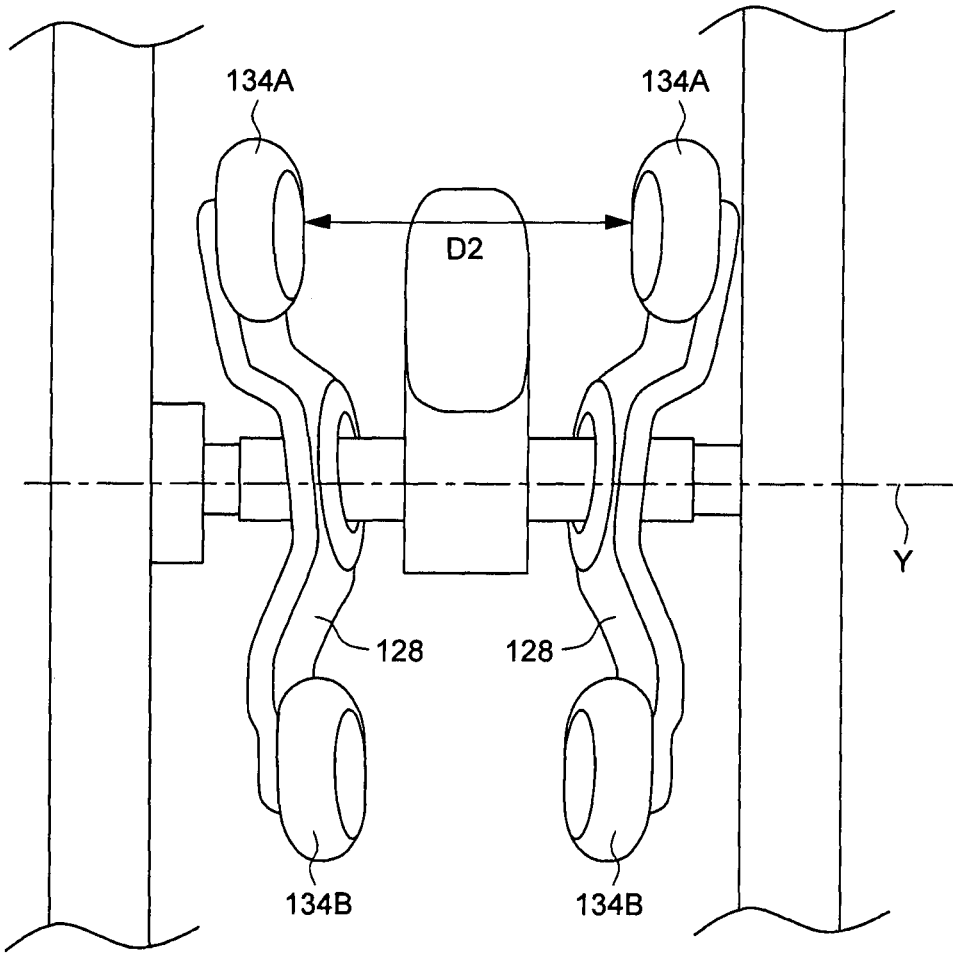
FIG. 5 is a schematic view illustrating the massage arms of the back massaging module having the upper contact members in a wide state.
Figure 6:
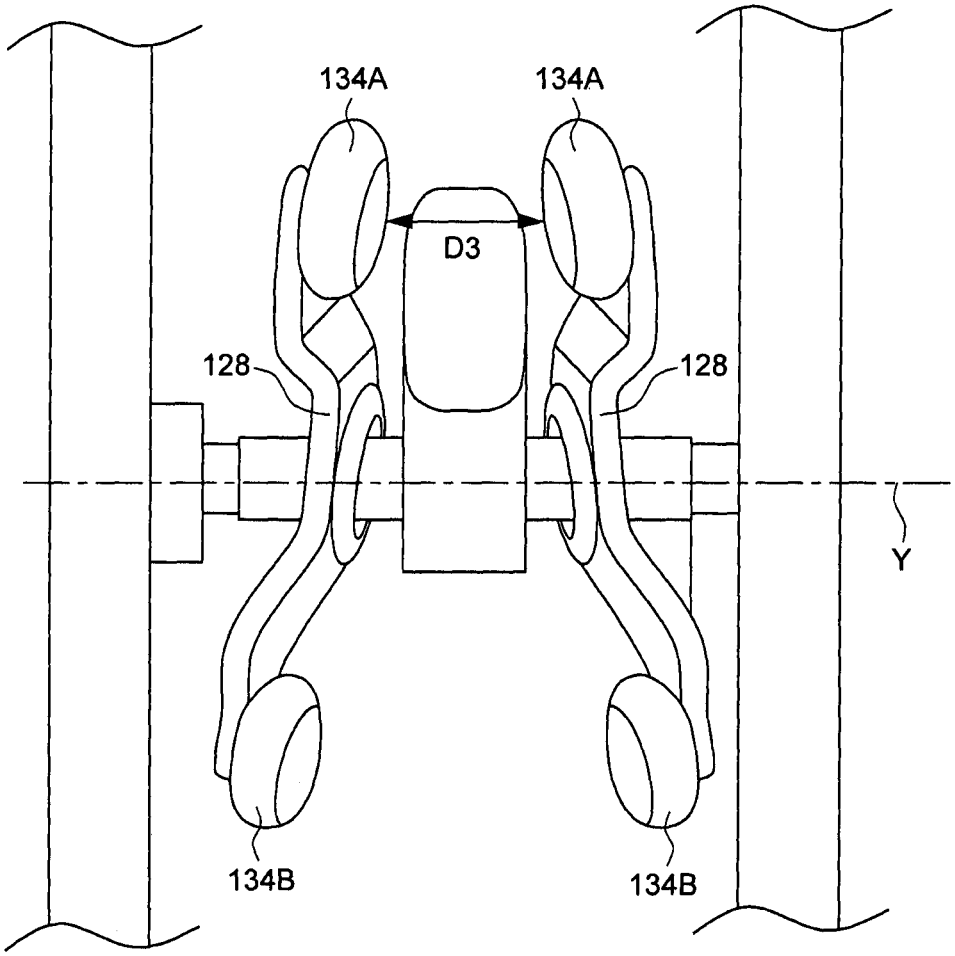
FIG. 6 is a schematic view illustrating the massage arms of the back massaging module having the upper contact members in a medium state.

The kneading drive portion 136 as described herein can produce kneading massage actions. Moreover, the output of the kneading motor 144 in the kneading drive portion 136 can be controlled so as to position the contact members 134A (and 134B) relatively closer or farther from each other along the transversal axis Y. FIGS. 4-6 are schematic views illustrating exemplary states of the massage arms 128 that can be reached by controlling the revolution of the kneading motor 144 in the kneading drive portion 136. The massage arms 128 can be controllably placed in different configurations corresponding to different distances between the upper contact members 134A along the transversal axis Y.

In FIG. 4, D1 designates a smallest distance between the upper contact members 134A. This can correspond to a "narrow state" of the upper contact members 134A.

In FIG. 5, D2 designates a greatest distance between the upper contact members 134A that is larger than D1. This can correspond to a "wide state" of the upper contact members 134A.

In FIG. 6, D3 designates an intermediate distance between the upper contact members 134A that is greater than D1 and smaller than D2. This can correspond to a "medium state" of the upper contact members 134A.

Referring again to FIGS. 1-3, the tapping drive portion 138 can include a rotary shaft 148 extending transversally parallel to the rotary shaft 142, two spaced-apart eccentric parts 150 affixed with the rotary shaft 142 with a 180° phase difference, two housings 152 respectively assembled around the eccentric parts 150, a tapping motor 154 for driving rotation of the rotary shaft 148, and two crankshafts 156 respectively extending between the swing preventive mechanisms 146 and the housings 152. The rotary shaft 148 can be supported by a bearing 149 mounted for free up and down movements along two rail portions 157 affixed with the platform 122. The tapping motor 154 can be coupled integrally with the bearing 149, so that the tapping motor 154, the rotary shaft 148 and the bearing 149 can move along the lengthwise axis Z relative to the platform 122. Each of the crankshafts 156 can have a lower end that is coupled with the bent central region of the massage arm 128 via the swing preventive mechanism 146 described previously.

When the rotary shaft 148 is driven in rotation by the tapping motor 154, the eccentric parts 150 can rotate eccentrically relative to the axis of the rotary shaft 148, which cause the housings 152 to move circumferentially for transmitting a vertical pull and push action through the crankshafts 156 to the massage arms 128. As a result, the massage arms 128 can pivot about the rotary shaft 142, and the contact members 134A and 134B can move in opposite directions relative to the front-rear axis X. More specifically, the motion of the left and right massage arms 128 can occur in alternate manner owing to the 180° phase difference between the two eccentric parts 150 (i.e., the upper contact member 134A of the left massage arm 128 moves forward while the contact member 134A of the right massage moves rearward, and vice versa). This operation can produce a tapping action on the user's body.

Referring again to FIG. 2, the forward positioning mechanism 123 can be operable to cause the massage arms 128 to rotate about the rotary shaft 142 so as to modify a forward displacement of the contact members 134A and 134B along the front-rear axis X. While the massage arms 128 are placed at a given position along the lengthwise axis Z, the displacement effected by the forward positioning mechanism 123 can allow to apply or remove a pressure exerted by the contact members 134A and 134B into the body. In one embodiment, the forward positioning mechanism 123 can include a guide body 160 located midway between the two massage arms 128, a slider 162 disposed inside the guide body 160, a feed screw 164 and an electric motor 166.

The guide body 160 can be affixed with the bearing 149, and can have the shape of a box that has a slot along which the slider 162 can be guided for vertical movement along the lengthwise axis Z. The slider 162 can have a vertical threaded hole through which the feed screw 164 can be engaged. The feed screw 164 can be operatively connected with the electric motor 166 via the assembly of a worm wheel and worm gear (not shown). A rotation of the feed screw 164 driven by the electric motor 166 can thereby cause up and down movements of the slider 162 in the guide body 160.

When the feed screw 164 rotates in a first direction, the slider 162 can move upward until it abuts against an upper edge 174 of the guide body 160. Once the slider 162 engages with the upper edge 174, further rotation of the feed screw 164 in the first direction causes the slider 162 to push the guide body 160, the bearing 149 and the tapping motor 154 upward. The upward displacement of the bearing 149 and the tapping motor 154 can be transmitted through the crankshafts 156 to the massage arms 128, which cause the massage arms 128 to rotate about the rotary shaft 142 in a direction for concurrently moving the upper contact members 134A forward and retracting the lower contact members 134B backward. This displacement may allow the upper contact members 134A and/or lower contact members 134B to apply pressure on desired regions of the body.

When the feed screw 164 rotates in a second direction opposite to the first direction, the slider 162 can move downward until it abuts against a lower edge 176 of the guide body 160. Once the slider 162 engages with the lower edge 176, further rotation of the feed screw 164 in the second direction causes the slider 162 to push the guide body 160, the bearing 149 and the tapping motor 154 downward. The downward displacement of the bearing 149 and the tapping motor 154 can be transmitted through the crankshafts 156 to the massage arms 128, which cause the massage arms 128 to rotate about the rotary shaft 142 in another direction for concurrently moving the lower contact members 134B forward and retracting the upper contact members 134A backward.

Figure 7:
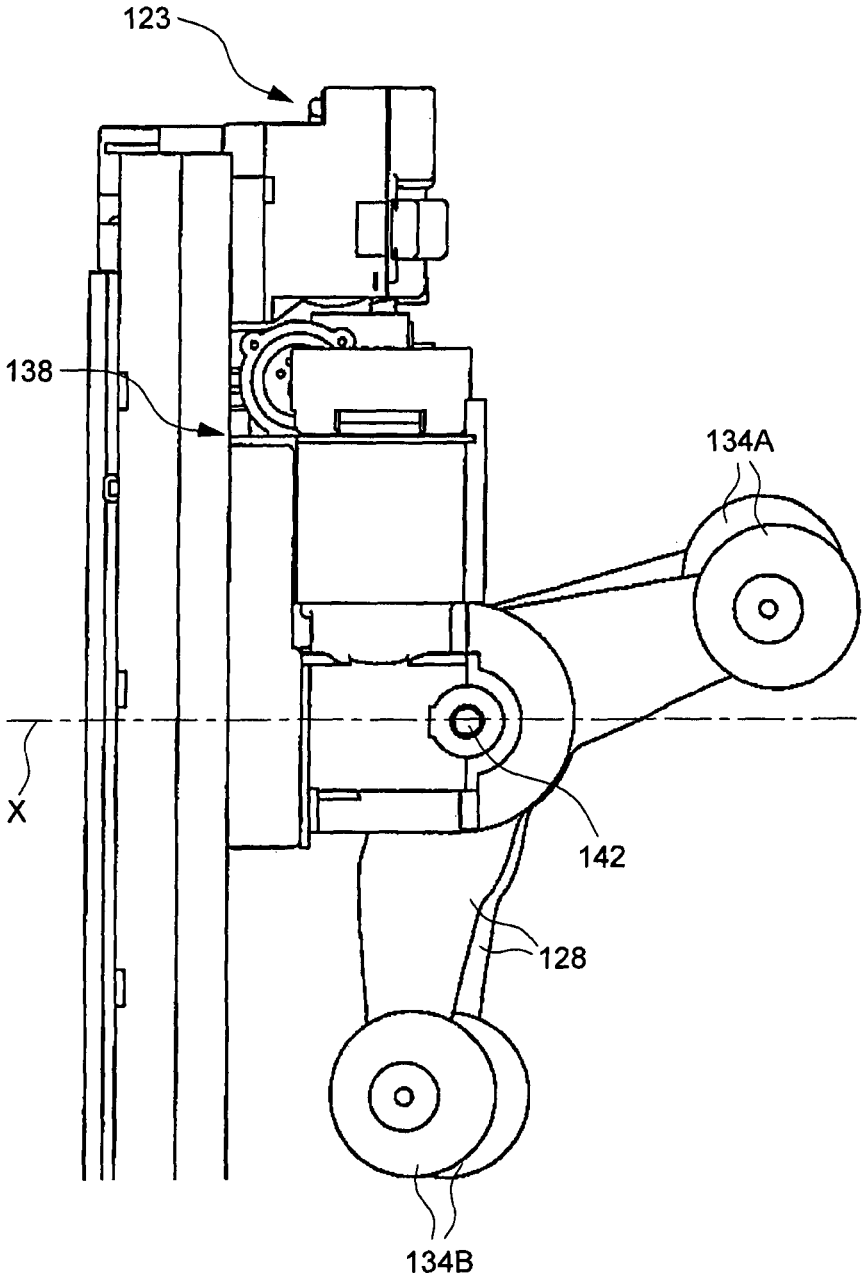
FIG. 7 is a schematic view illustrating a state where the upper contact members of the massage arms are displaced forward along a front-rear axis of the backrest.
Figure 8:
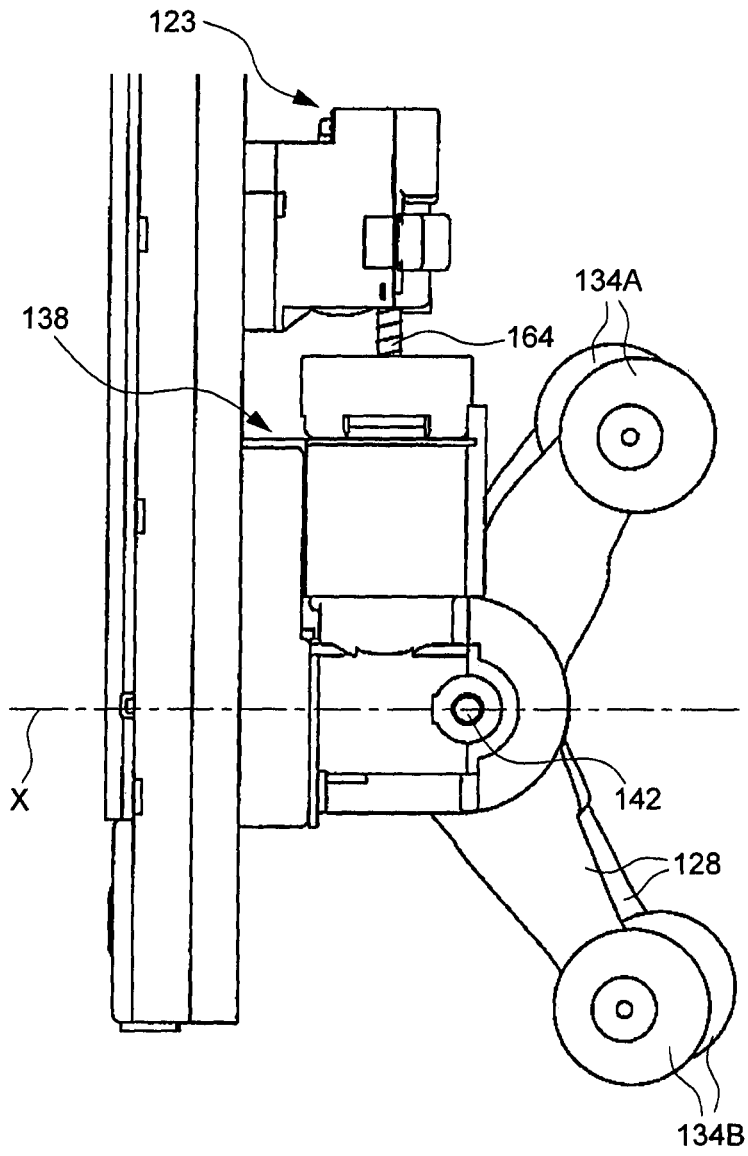
FIG. 8 is a schematic view illustrating a state where the upper contact members of the massage arms are retracted backward along the front-rear axis of the backrest compared to the position shown in FIG. 7.

FIGS. 7 and 8 are schematic views illustrating two exemplary states of the massage arms 128 that can be reached by controlling the actuation of the electric motor 166 in the forward positioning mechanism 123. In FIG. 7, the massage arms 128 are shown in a state where the upper contact members 134A are displaced forward along the front-rear axis X toward a user's body, whereas the lower contact members 134B are retracted backward. In FIG. 8, the massage arms 128 are shown in another state where the upper contact members 134A are retracted backward compared to the state shown in FIG. 7, whereas the lower contact members 134B are displaced forward.

Referring again to FIGS. 2 and 3, the vertical driving unit 124 can be operable to move the massage arms 128 along the lengthwise axis Z. The vertical driving unit 124 can include a pair of rails 180, guide rollers 182, a screw shaft 184 and an electric motor 186. The rails 180 can be affixed inside the backrest 104, and extend along the lengthwise axis Z. The guide rollers 182 can be disposed at the left and right sides of an upper and lower region of the platform 122, and can be guided for movement along the rails 180. The screw shaft 184 can engage with a built-in nut (not shown) provided in the platform 122, and can be driven in rotation by the electric motor 186. When the screw shaft 184 is driven in rotation by the electric motor 186, the platform 122 and the massage dispensing mechanism 120 can move up and down in unison along the lengthwise axis Z.

Figure 9:
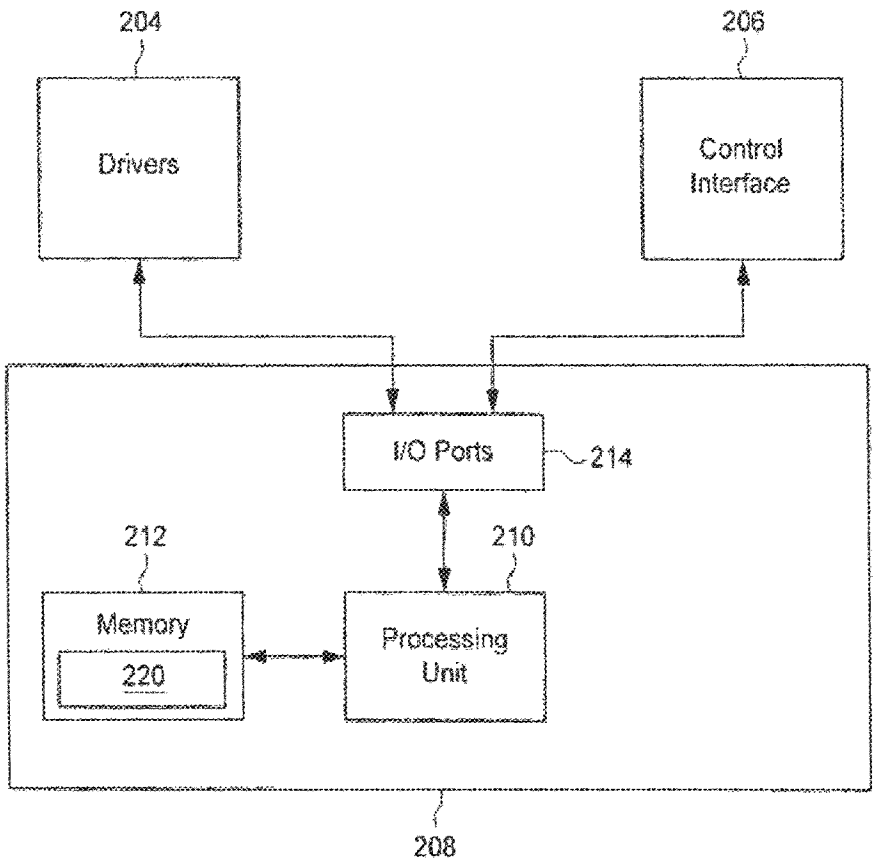
FIG. 9 is a simplified block diagram illustrating one embodiment of a control system implemented in the massage apparatus.
Figure 10:
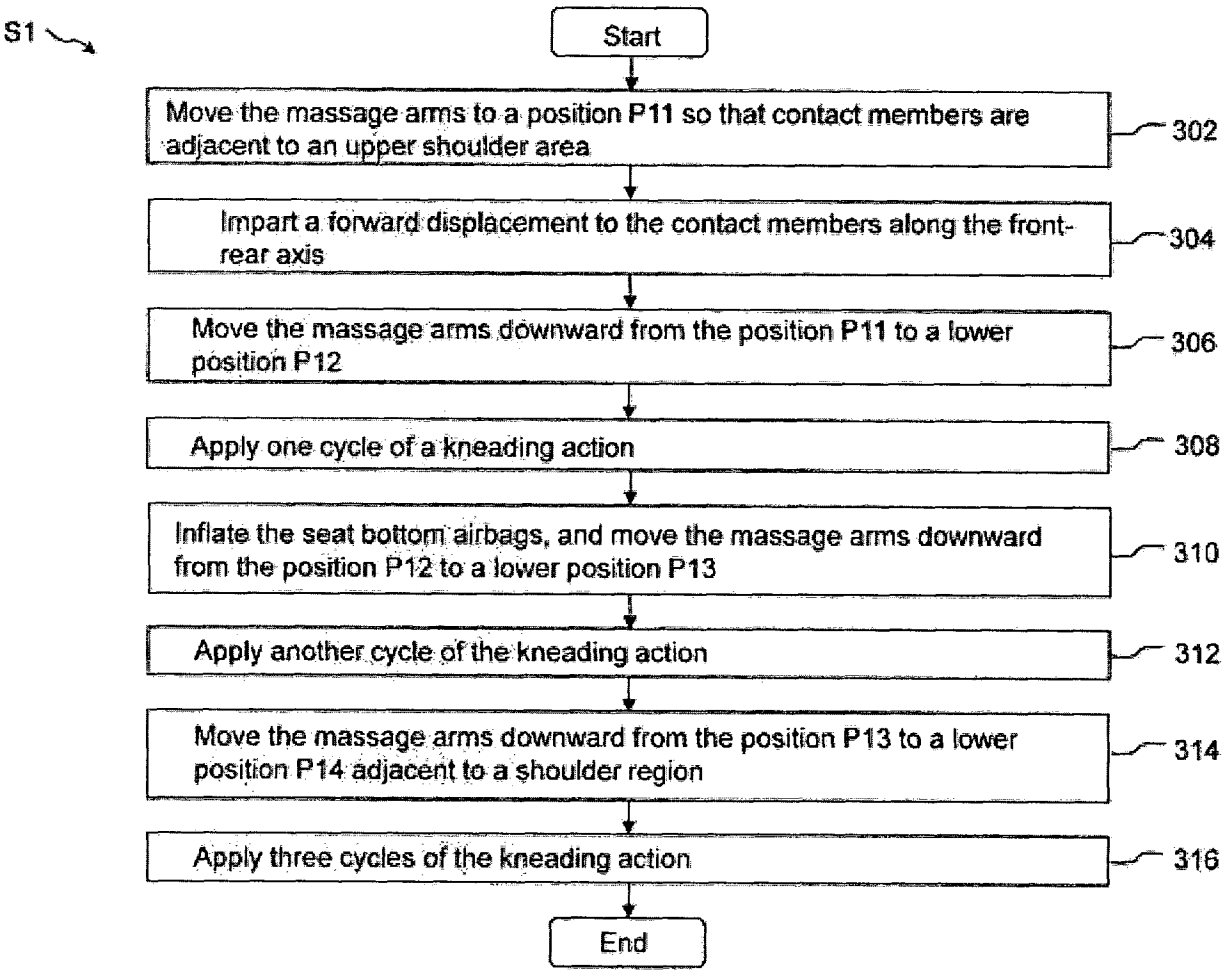
FIG. 10 is a flowchart illustrating method steps of a sequence of massage actions S1 implemented in the massage apparatus.

FIG. 9 is a simplified block diagram illustrating one embodiment of a control system 202 implemented in the massage apparatus 100. The control system 202 can include a plurality of drivers 204, a control interface 206 and a microcontroller 208. The drivers 204 can be electric circuits operable to drive operation of various components of the massage apparatus 100 according to control signals outputted by the microcontroller 208. Examples of components driven by the drivers 204 can include the respective motors 144 and 154 of the kneading drive portion 136 and tapping drive portion 138, the electric motor 186 of the vertical driving unit 124, the electric motor 166 of the forward positioning mechanism 123, the pumps (not shown) associated with the airbags 110 and 111, solenoids, etc.

The control interface 206 can be connected with sensors and limit switches arranged in the massage apparatus 100, and can deliver various detection signals to the microcontroller 208 to provide information such as physical height of the user, limits of movements, motor revolutions, etc.

The microcontroller 208 can control and supervise the operation of the massage apparatus 100. In one embodiment, the microcontroller 208 can exemplary be a 32-bit Reduced Instruction Set Computing (RISC) microcontroller. The microcontroller 208 can select one of a plurality of massage programs stored internally, and execute the selected massage program through the drivers 204. In one embodiment, the microcontroller 208 can exemplary include a processing unit 210, a memory 212 for storing massage program codes, and input/output (I/O) ports 214 through which the processing unit 210 can exchange signals with the drivers 204 and the control interface 206.

The memory 212 can store the codes of multiple massage programs 220 available in the massage apparatus 100. Each of the massage programs 220 can be executable by the processing unit 210 so as to actuate the massage arms 128 to perform a sequence of predetermined massage actions on a user's body. All the displacements of the massage arms 128 can be conducted in a spatial coordinate system defined by the lengthwise axis Z, the transversal axis Y and the front-rear axis X.

Figure 11A:
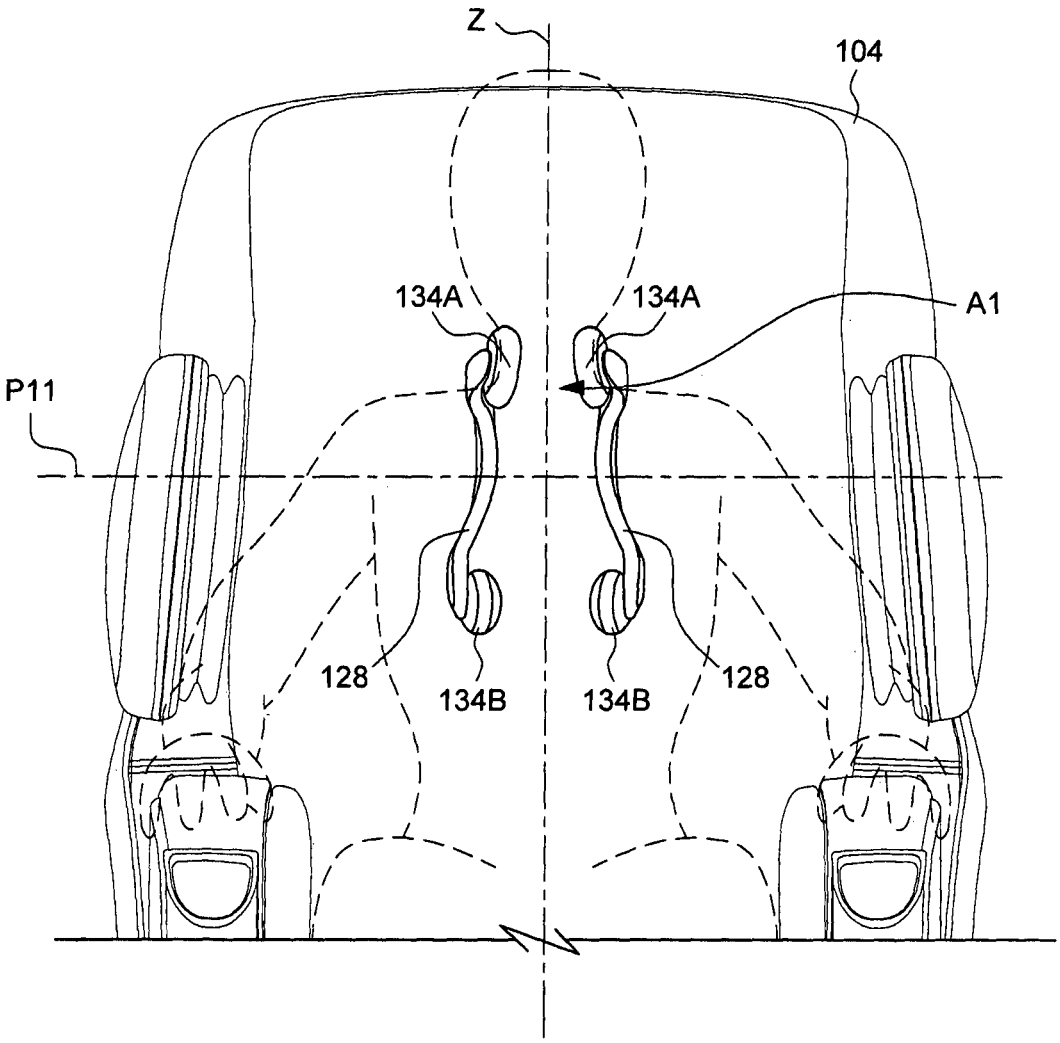
FIGS. 11A-11D are schematic views illustrating different positions of the massage arms during the sequence of massage actions S1.

In conjunction with FIGS. 1-3, FIG. 10 is a flowchart of a sequence of massage actions S1 implemented in the massage apparatus 100, and FIGS. 11A-11D are schematic views illustrating different positions of the massage arms 128 during the sequence of massage actions S1. In step 302, the massage arms 128 can be displaced by the vertical driving unit 124 along the lengthwise axis Z to a position P11 so that the upper contact members 134A can be placed adjacent to an upper shoulder area A1 of a user's body, as shown in FIG. 11A. While the massage arms 128 are in the position P11, the upper contact members 134A can be placed in the narrow state as shown in FIG. 4, touching the upper shoulder area A1.

In step 304, while the massage arms 128 are in the position P11, the massage arms 128 can be actuated to cause a forward displacement X11 of the upper contact members 134A along the front-rear axis X toward the body. This forward displacement of the upper contact members 134A can be driven by the actuation of the forward positioning mechanism 123 as described previously.

Figure 11B:
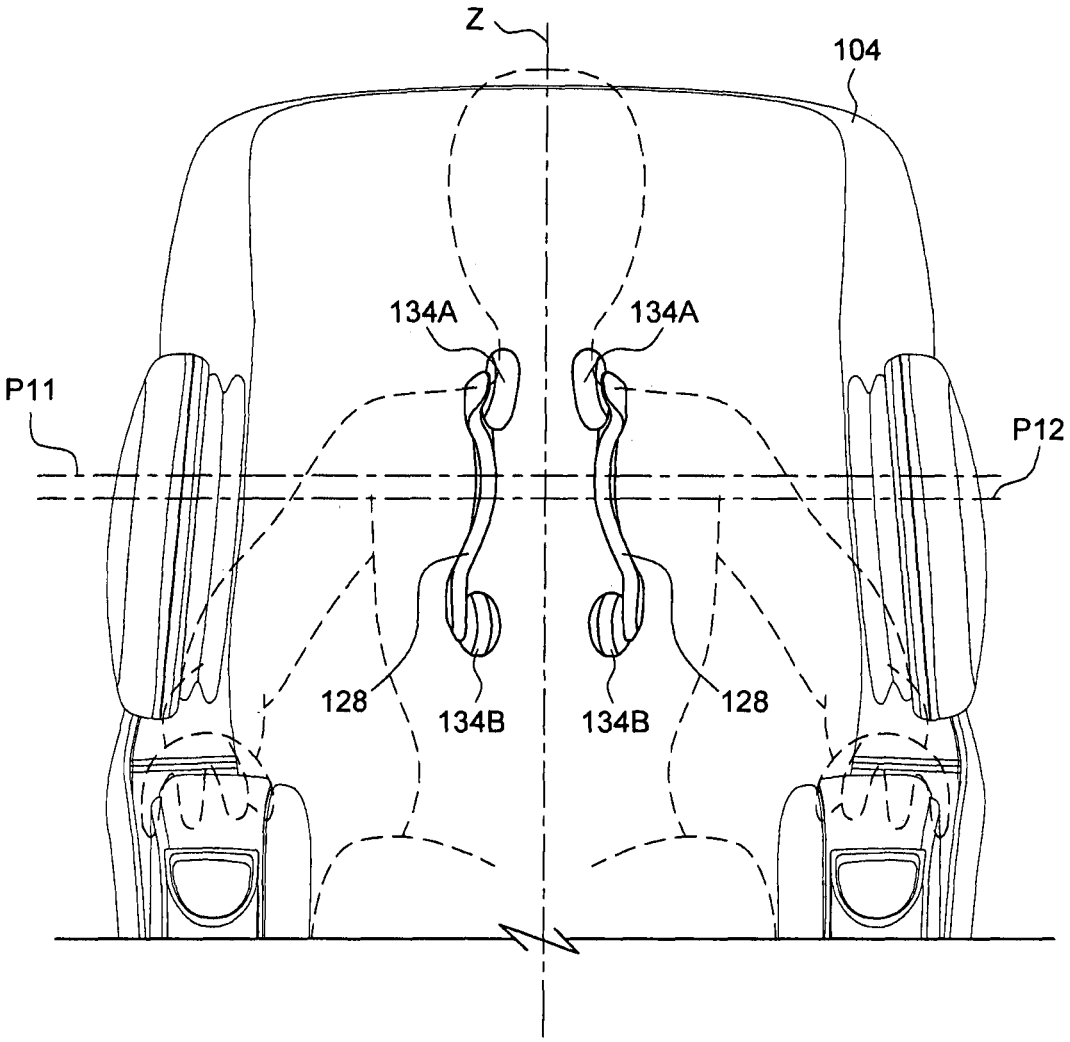

In step 306, the massage arms 128 then can be moved downward along the lengthwise axis Z from the position P11 to a position P12 as shown in FIG. 11B. In step 308, while the massage arms 128 are in the position P12, the kneading drive portion 136 can be actuated to cause the upper contact members 134A to apply one single cycle of the kneading massage action. During one cycle of the kneading massage action, the upper contact members 134A can travel once from the narrow state shown in FIG. 4 toward the wide state shown in FIG. 5, and once from the wide state back to the narrow state.

Figure 11C:
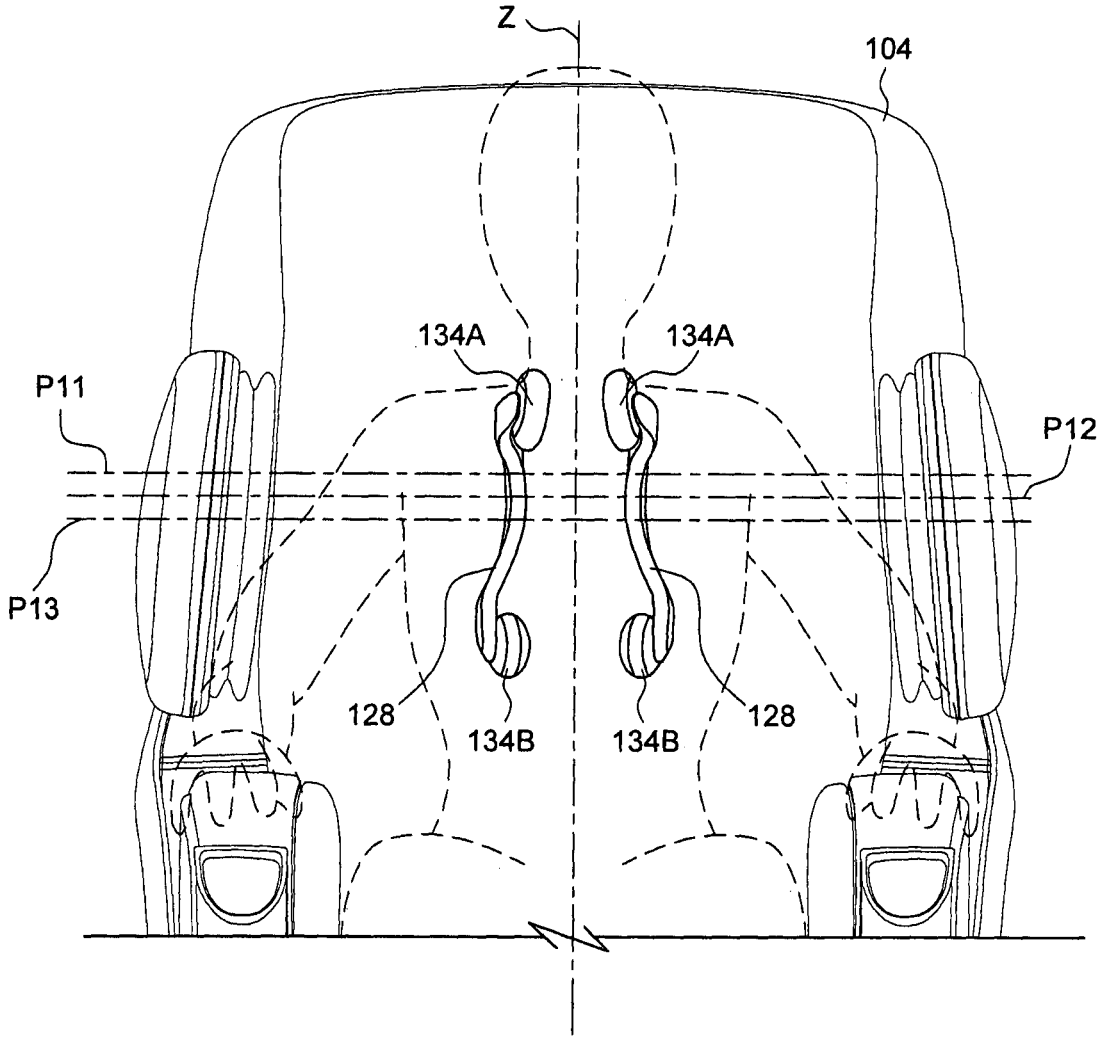

In step 310, the bottom airbags 110 in the seat 102 can be inflated, and the vertical driving unit 124 can be concurrently actuated to move the massage arms 128 downward from the position P12 to a lower position P13 as shown in FIG. 11C. While the massage arms 128 are in the position P13 and the upper contact members 134A are in the narrow state, the kneading drive portion 136 in step 312 can be actuated to cause the upper contact members 134A to apply another single cycle of the kneading massage action like described in step 308.

Figure 11D:
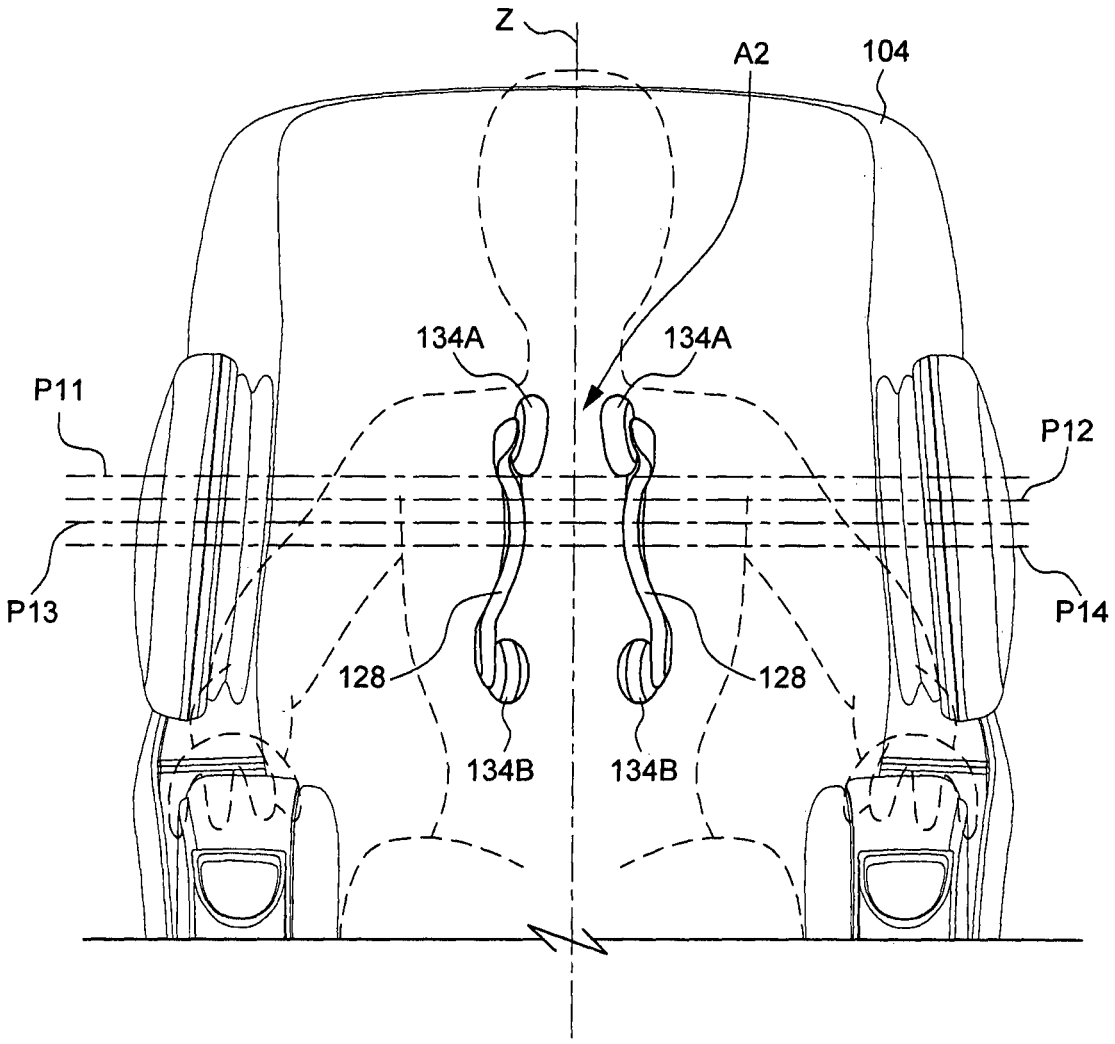

While the bottom airbags 110 in the seat 102 continue to inflate, the body slowly moves upward, and the vertical driving unit 124 in step 314 can be actuated to move the massage arms 128 further downward from the position P13 to a lower position P14 adjacent to a shoulder region A2 as shown in FIG. 11D. In next step 316, while the massage arms 128 are in the position P14, the kneading drive portion 136 can be actuated to cause the upper contact members 134A to apply three cycles of the kneading massage action.

In one embodiment, the sequence of massage actions S1 can take about one to about two minutes to complete. The sequence of massage actions S1 can apply a quick scraping massage to effectively relieve the tension and pain in the upper shoulder and shoulder areas.

Figure 12:
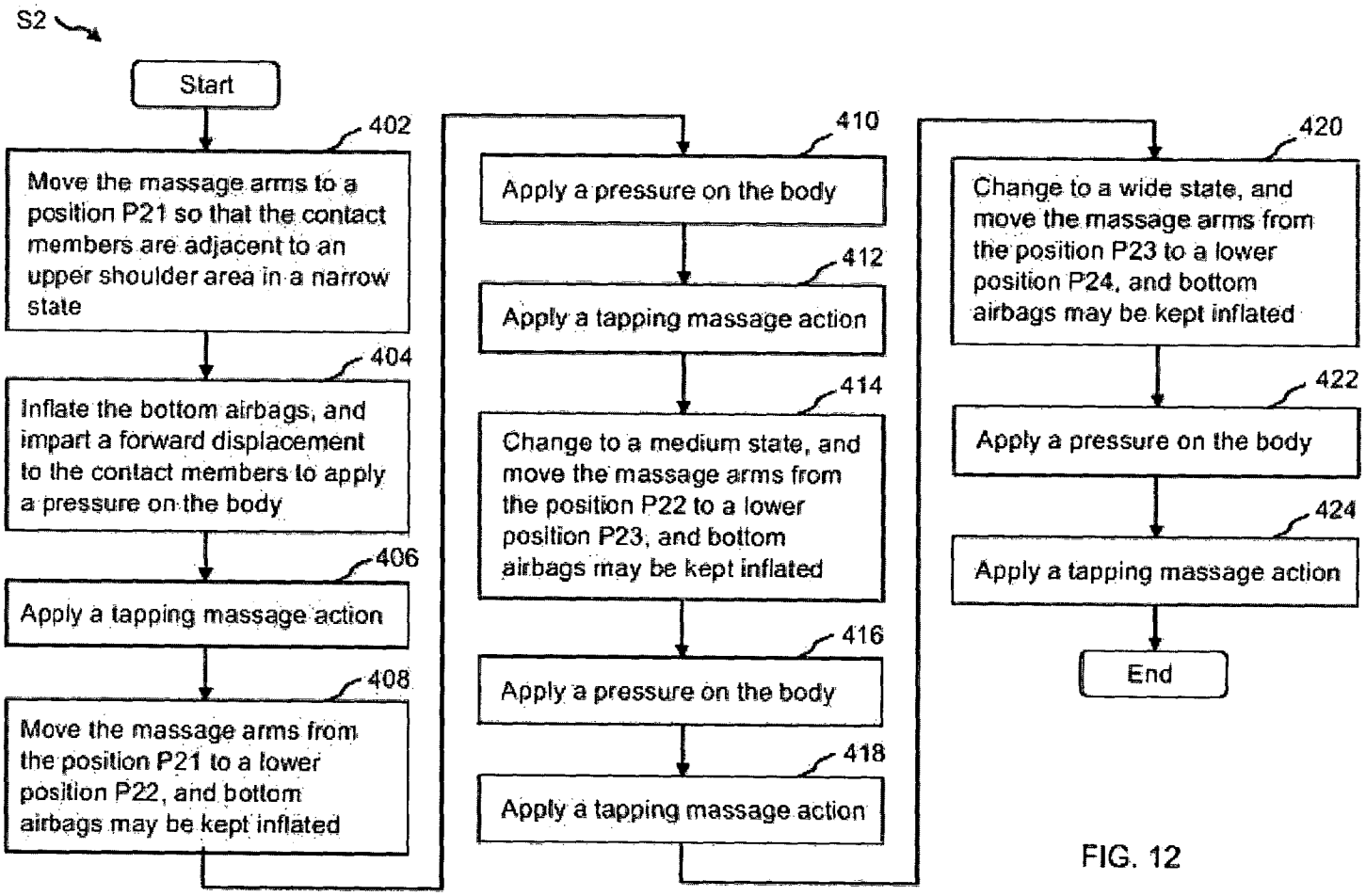
FIG. 12 is a flowchart illustrating method steps of another sequence of massage actions S2 that may be implemented in the massage apparatus.
Figure 13A:
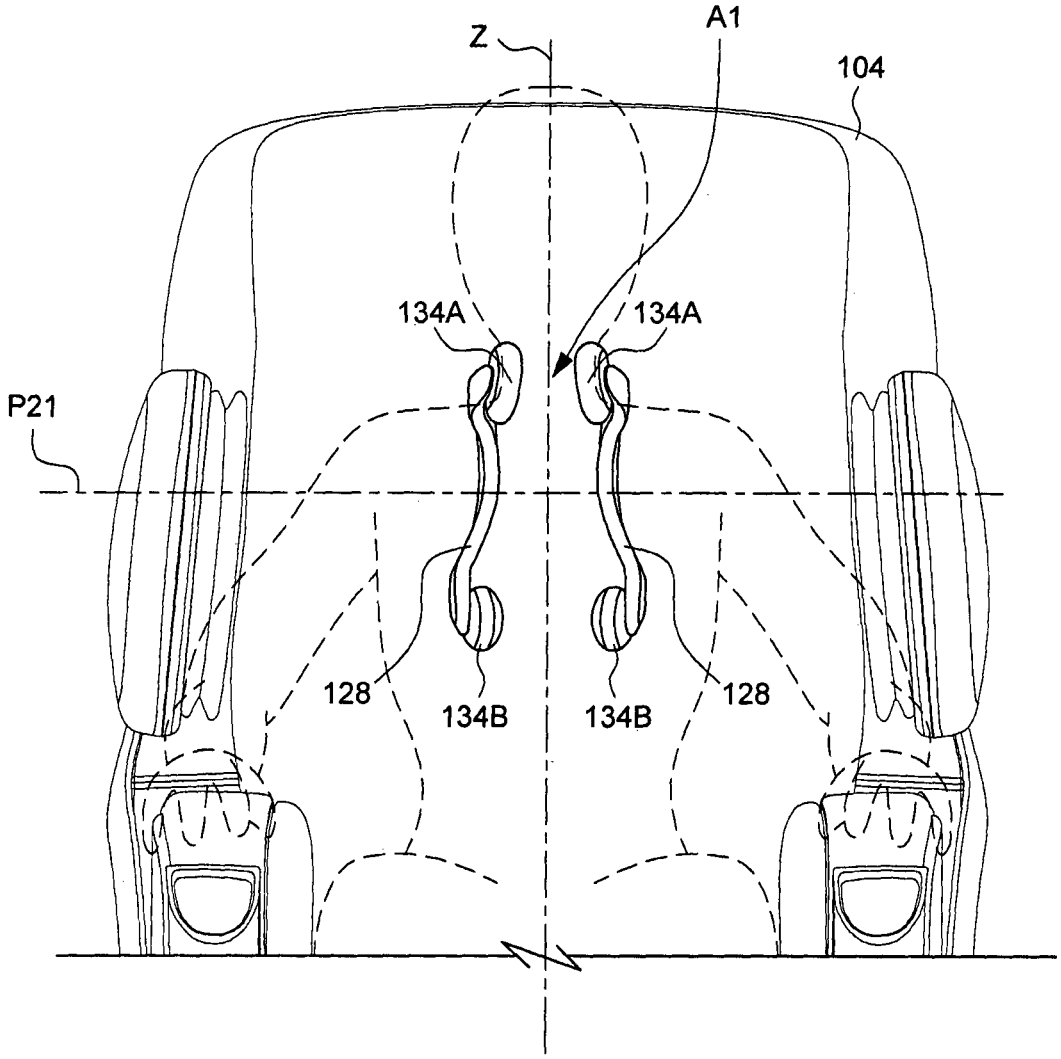
FIGS. 13A-13D are schematic views illustrating different positions of the massage arms during the sequence of massage actions S2.

FIG. 12 is a flowchart illustrating method steps of another sequence of massage actions S2 that may be implemented in the massage apparatus 100, and FIGS. 13A-13D are schematic views illustrating different positions of the massage arms 128 during the application of the sequence of massage actions S2. In initial step 402, the massage arms 128 can be displaced by the vertical driving unit 124 to a position P21 so that the upper contact members 134A can touch the upper shoulder area A1 of a user's body, as shown in FIG. 13A. While the massage arms 128 are in the position P21, the upper contact members 134A can be placed in the narrow state as shown in FIG. 4.

In next step 404, while the massage arms 128 are in the position P21, the bottom airbags 110 in the seat 102 can be inflated, and the massage arms 128 can be actuated by the forward positioning mechanism 123 to cause a forward displacement X21 of the upper contact members 134A into the body. A shiatsu type pressure can be thereby applied and held for a time duration T21.

Once the time duration T21 has lapsed, the tapping drive portion 138 in step 406 can be operated so that the upper contact members 134A in the narrow state can apply a tapping massage action for a time duration T22 to release the tension.

Figure 13B:
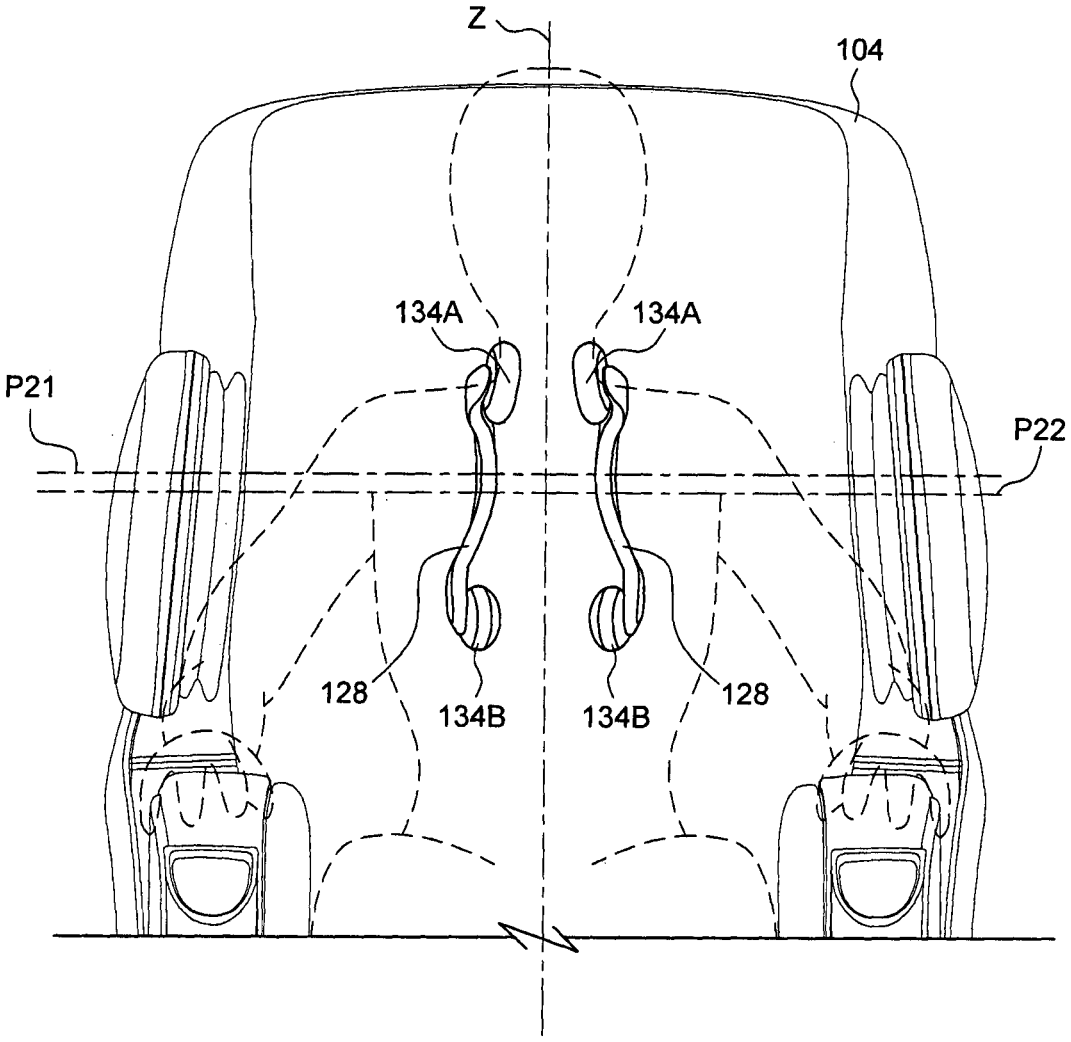

In subsequent step 408, the vertical driving unit 124 can be actuated to move the massage arms 128 downward from the position P21 to a lower position P22 as shown in FIG. 13B. In step 410, while the massage arms 128 are in the position P22, the forward displacement of the upper contact members 134A can apply a pressure into to the body for a time duration T23. The bottom airbags 110 may be kept inflated during steps 408 and 410.

Once the time duration T23 has lapsed, the tapping drive portion 138 in step 412 can be operated so that the upper contact members 134A can tap the same area for a time duration T24, which further release tension in the upper shoulder to shoulder area.

Figure 13C:
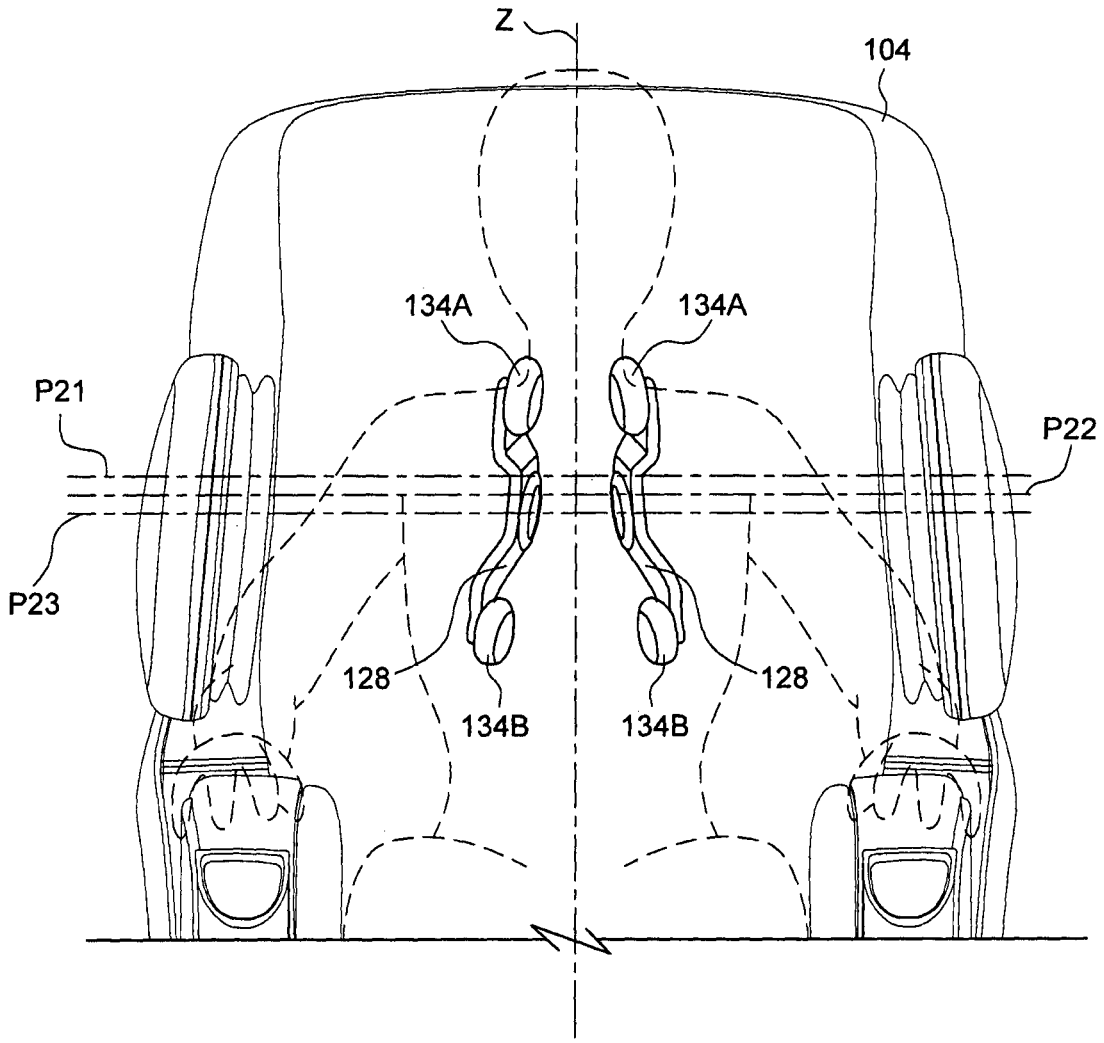

In subsequent step 414, the kneading drive portion 136 then can be operated to change the upper contact members 134A from the narrow state shown in FIG. 4 to the medium state shown in FIG. 6, and the vertical driving unit 124 can be actuated to move the massage arms 128 downward from the position P22 to a lower position P23 as shown in FIG. 13C. The bottom airbags 110 may be kept inflated during step 414.

In step 416, while the massage arms 128 are in the position P23, the upper contact members 134A in the medium state can apply a pressure into the body for a time duration T25.

Once the time duration T25 has lapsed, the tapping drive portion 138 in step 418 can be operated so that the upper contact members 134A can tap the same area for a time duration T26. This tapping action is performed while the massage arms 128 are in the medium state and at the position P23.

Figure 13D:
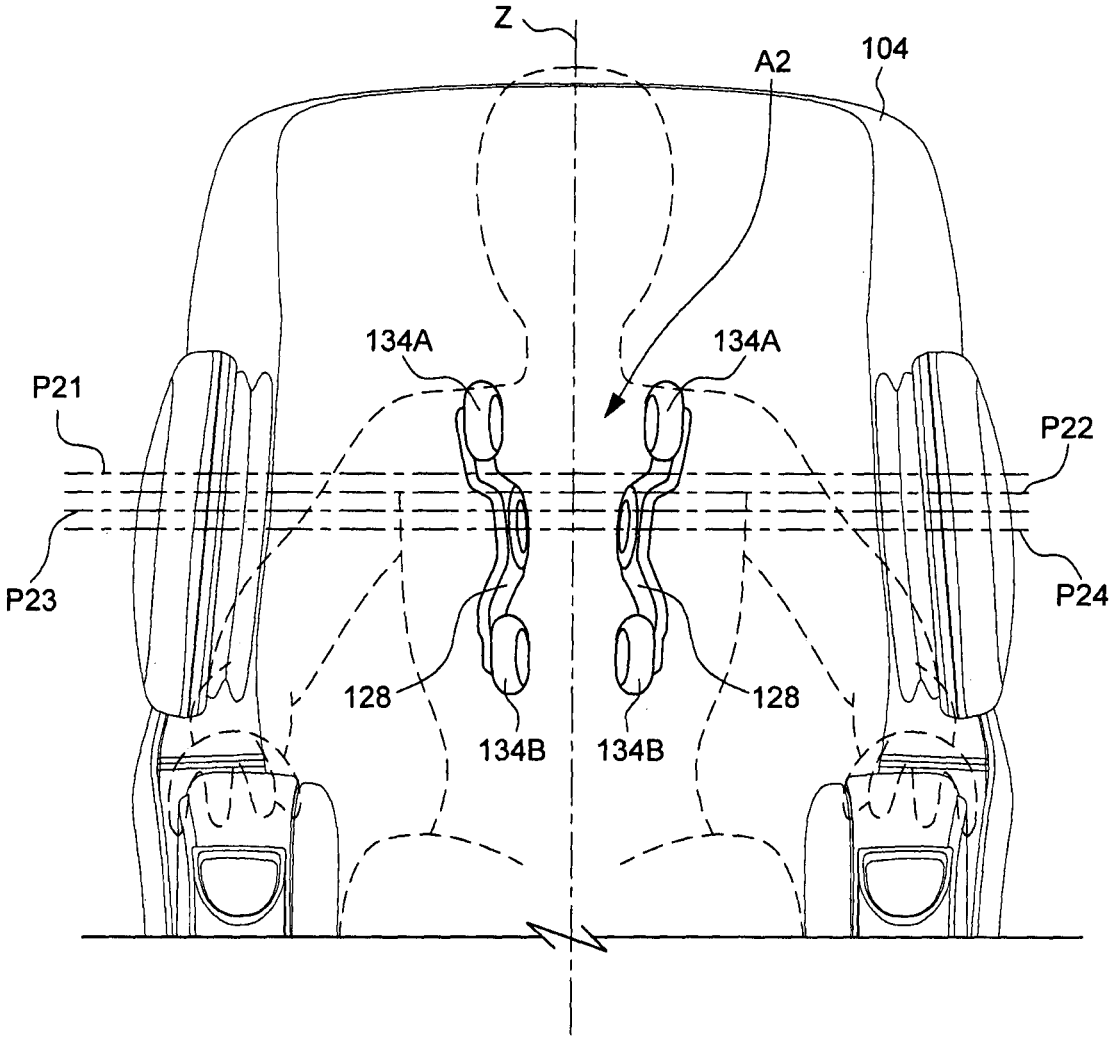

In next step 420, the kneading drive portion 136 can be operated to change the upper contact members 134A from the medium state shown in FIG. 6 to the wide state shown in FIG. 5, and the vertical driving unit 124 can be actuated to move the massage arms 128 downward from the position P23 to a lower position P24 as shown in FIG. 13D. The bottom airbags 110 may be kept inflated during step 420.

In step 422, while the massage arms 128 are in the position P24, the upper contact members 134A can apply a pressure into the body for a time duration T27.

Once the time duration T27 has lapsed, the tapping drive portion 138 in step 424 can be operated so that the upper contact members 134A can tap the same area for a time duration T28. This tapping action is performed while the Massage arms 128 are at the position P24 and in the wide state, which can release tension around a wide portion in the shoulder area A2.

The sequence of massage actions S2 can apply a quick scraping massage of about less than one minute to effectively relieve the tension and pain in the shoulder area.

Figure 14:
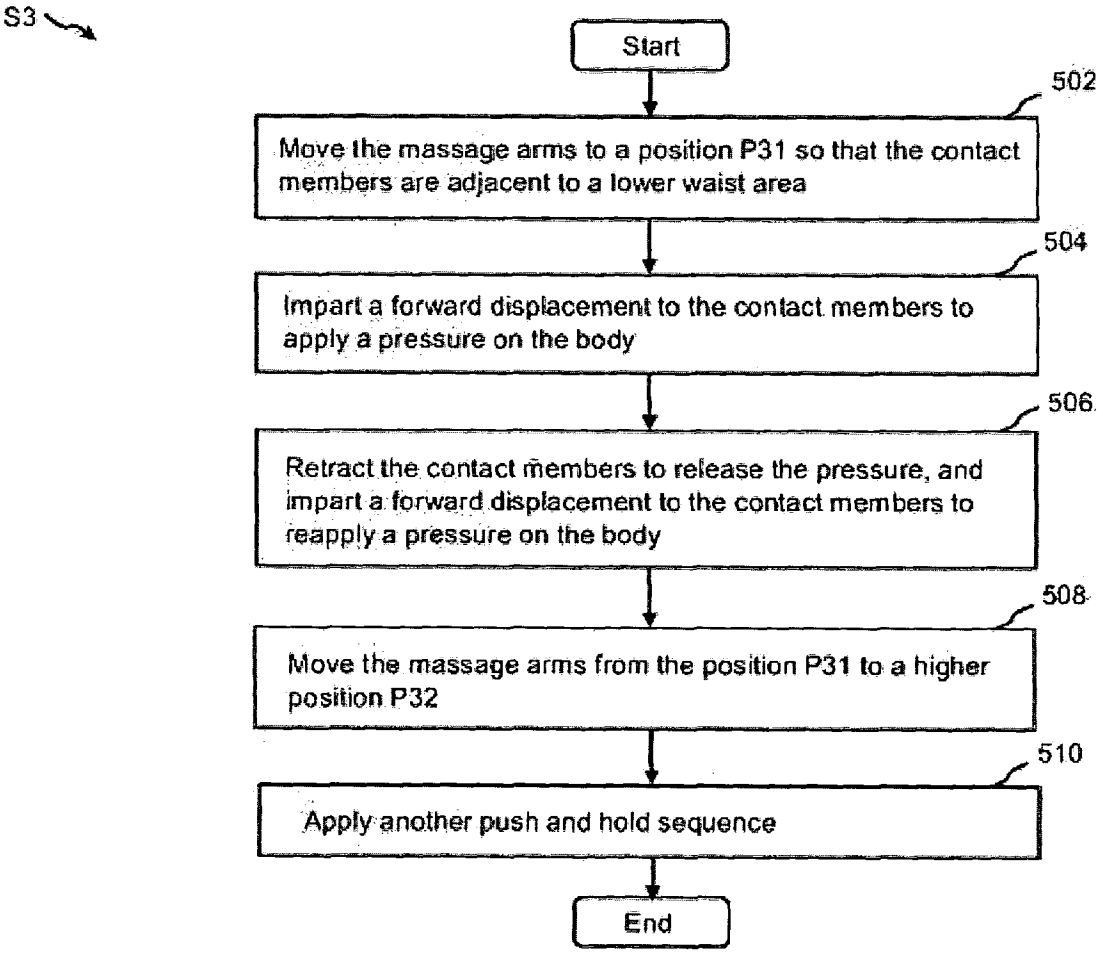
FIG. 14 is a flowchart illustrating method steps of another sequence of massage actions S3 that may be implemented in the massage apparatus.
Figure 15A:
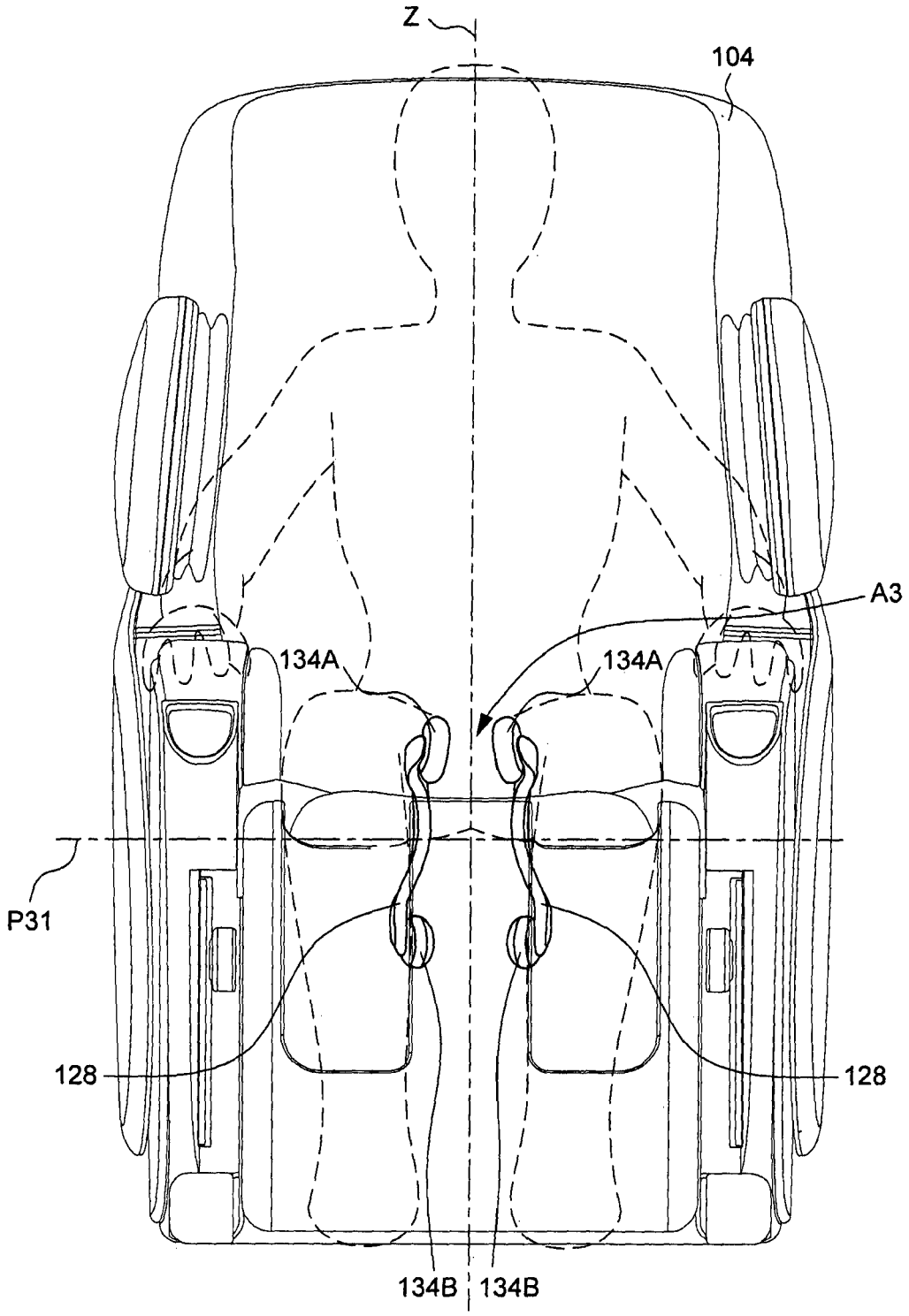
FIGS. 15A and 15B are schematic views illustrating different positions of the massage arms during the sequence of massage actions S3.
Figure 15B:
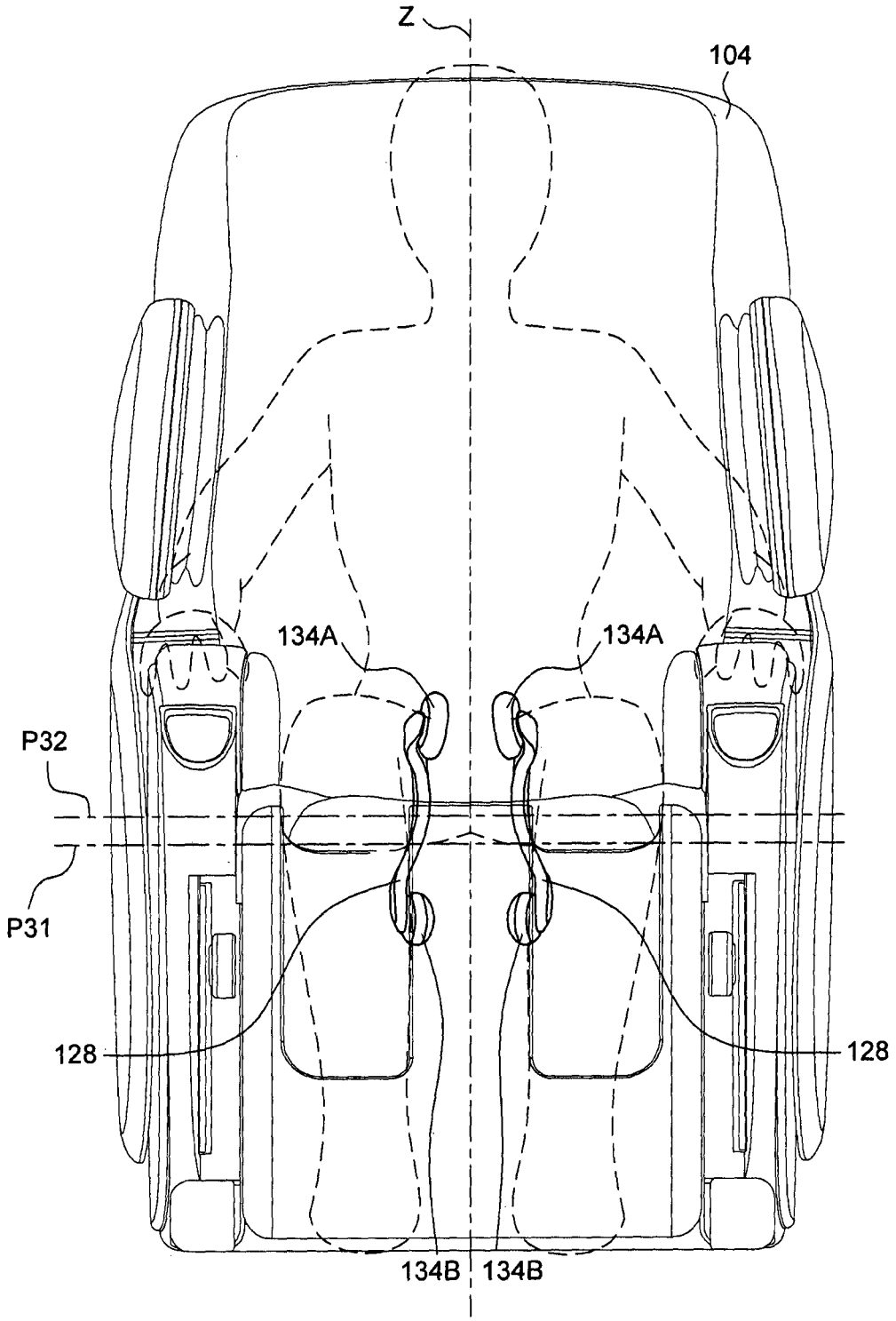

FIG. 14 is a flowchart of another sequence of massage actions S3 implemented in the massage apparatus 100, and FIGS. 15A and 15B are schematic views illustrating different positions of the massage arms 128 during the sequence of massage actions S3. In initial step 502, the massage arms 128 can be moved by the vertical driving unit 124 to a position P31, so that the upper contact members 134A can be placed adjacent to a lower waist area A3 as shown in FIG. 15A, and the lower contact members 134B are located adjacent to the seat 102. While the massage arms 128 are in the position P31, the upper contact members 134A can be placed in any of the narrow (as shown), medium and wide state, and can touch the lower back of the body.

In step 504, while the massage arms 128 are in the position P31, the massage arms 128 can be actuated by the forward positioning mechanism 123 to cause a forward displacement X31 of the upper contact members 134A into the body. A push action can be thereby applied and held for a time duration T31.

Once the time duration T31 has lapsed, the forward positioning mechanism 123 in step 506 can actuate the massage arms 128 to retract the upper contact members 134A backward to release the pressure, and then to impart another forward displacement X32 of the upper contact members 134A into the body. The forward displacement X32 can be made while the massage arms 128 are still in the position P31. In one embodiment, the forward displacement X32 may be equal or greater than the previous forward displacement X31. Another push action can be thereby applied and held for a time duration T32.

The aforementioned push and hold sequence can be repeated several times for a same area of the body. Moreover, a tapping action may be applied by the massage arms 128 to release tension immediately after each push and hold sequence: for example, a tapping action may be performed between steps 504 and 506.

In step 508, the massage arms 128 can be moved upward by the vertical driving unit 124 from the position P31 to higher position P32 as shown in FIG. 15B. In other embodiments, the massage arms 128 may also be moved downward from the position P31. In step 510, while the massage arms 128 are in the position P32, one or more push and hold sequence similar to those described in steps 504 and 506 can be repeated again. In one embodiment, the sequence of massage actions S3 can take less than about one to about two minutes to effectively relieve tension and pain around the lower back region.

Figure 16:
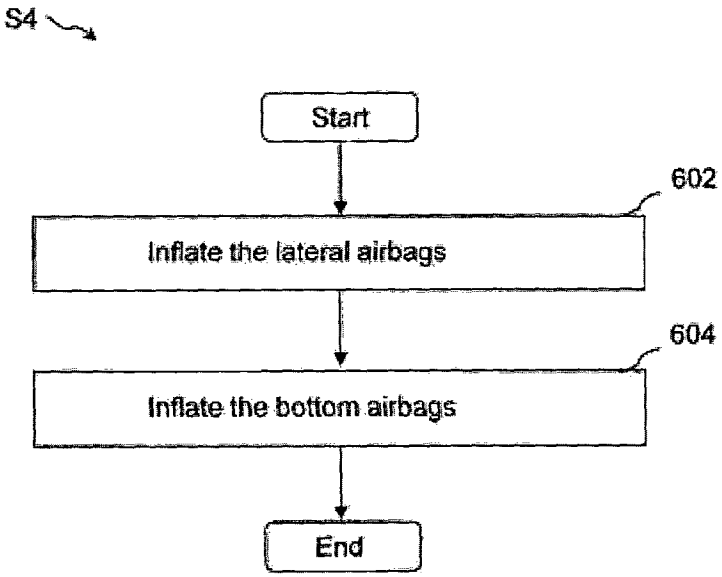
FIG. 16 is a flowchart illustrating method steps of another sequence of massage actions S4 implemented in the massage apparatus.

In conjunction with FIG. 1, FIG. 16 is a flowchart illustrating method steps of another sequence of massage actions S4 implemented in the massage apparatus 100. In step 602, the lateral airbags 111 can inflate to squeeze the left and right thighs for a time duration T41. Subsequently, the bottom airbags 110 of the seat 102 in step 604 can inflate for a time duration T42 to push upward the buttock. This short sequence of about one to about two minutes can provide toning effects around the thighs and hip areas.

Figure 17:
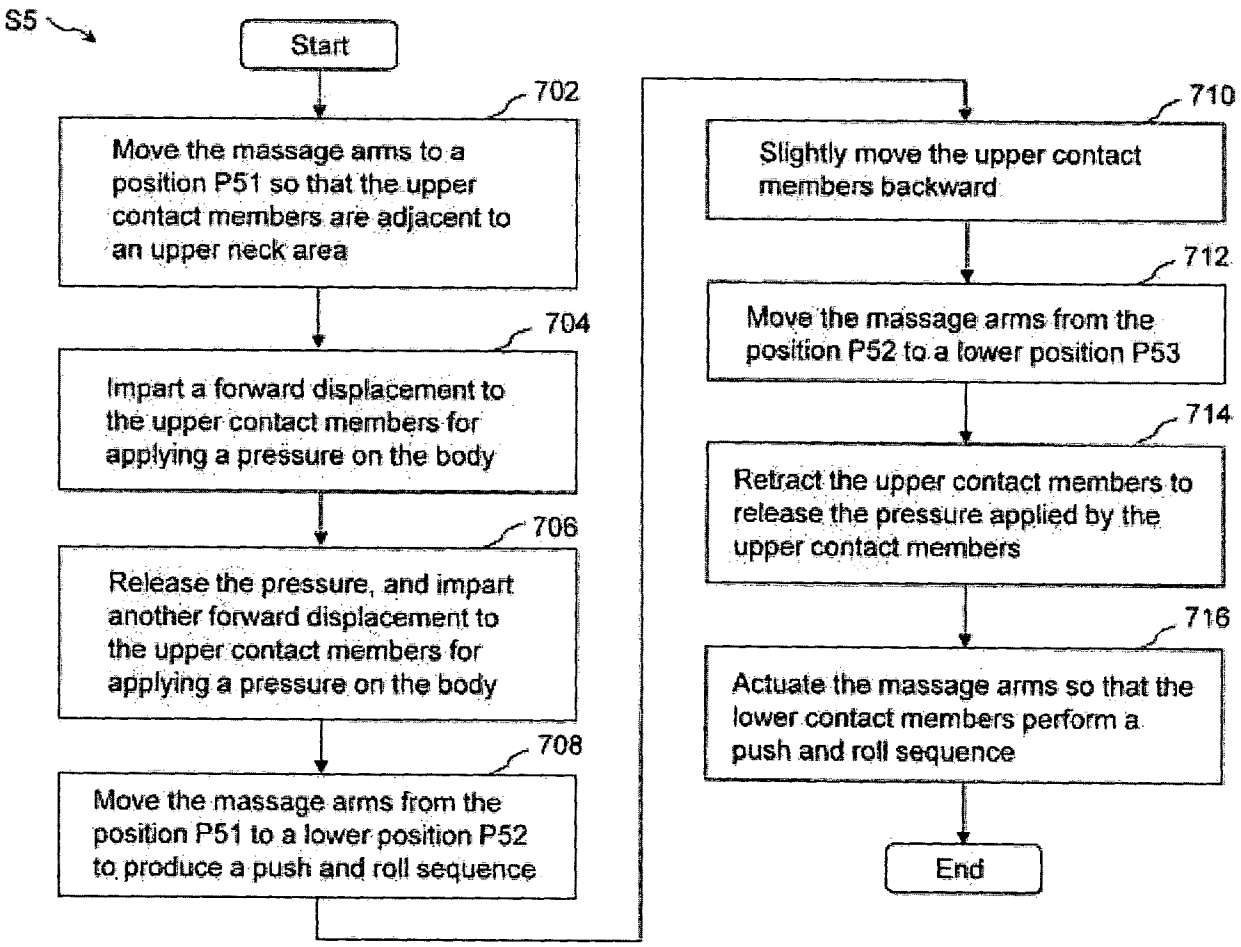
FIG. 17 is a flowchart illustrating method steps of another sequence of massage actions S5 implemented in the massage apparatus.
Figure 18A:
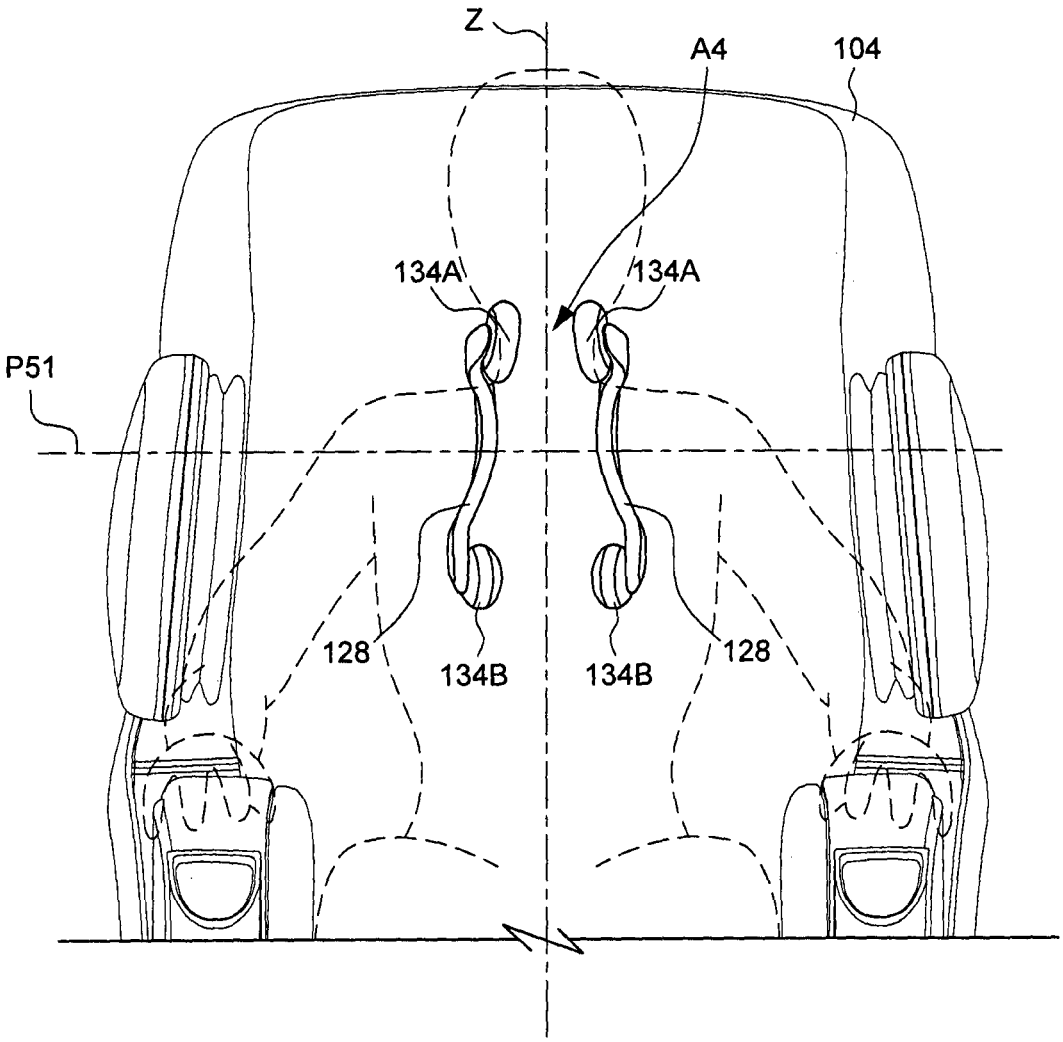
FIGS. 18A-18C are schematic views illustrating different positions of the massage arms during the sequence of massage actions S5.
Figure 18B:
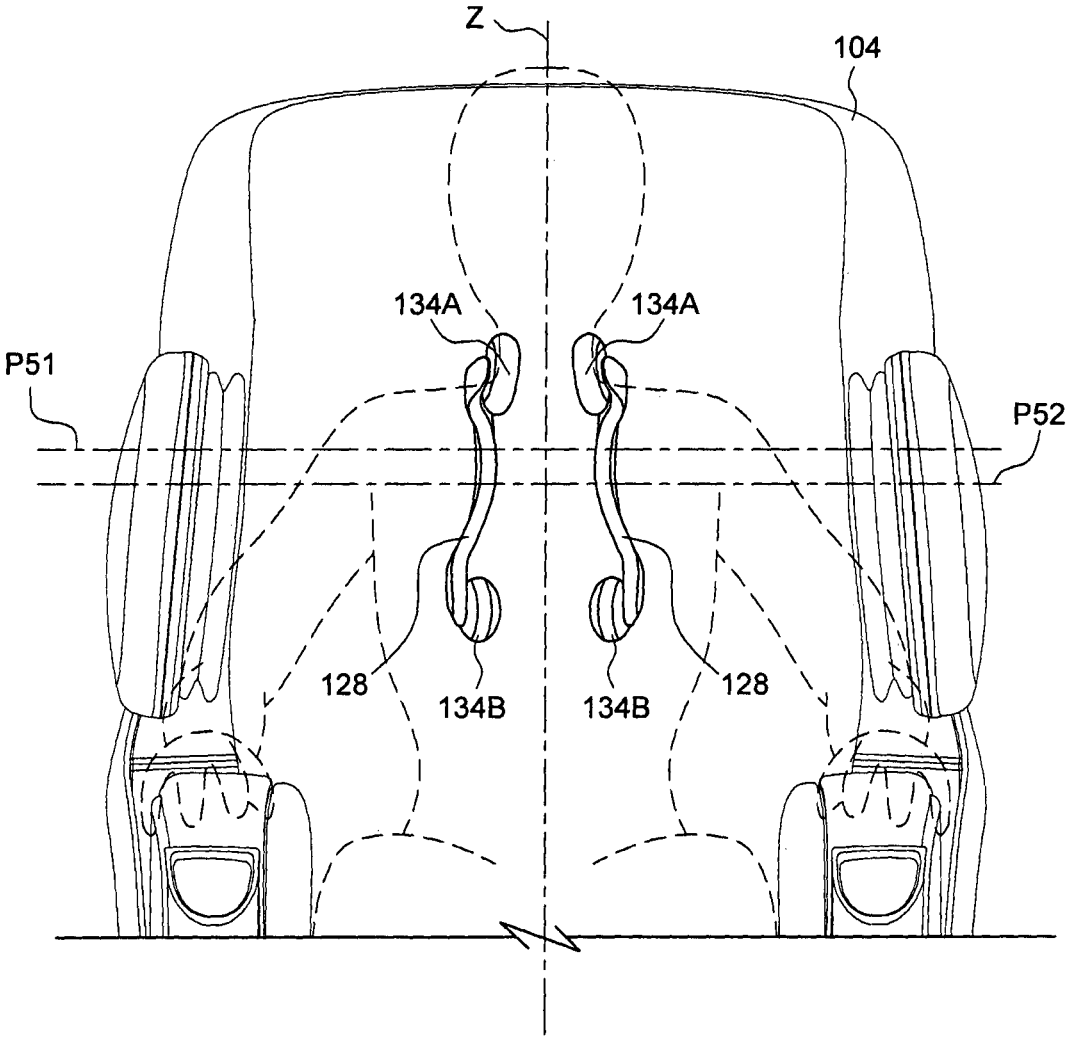
Figure 18C:
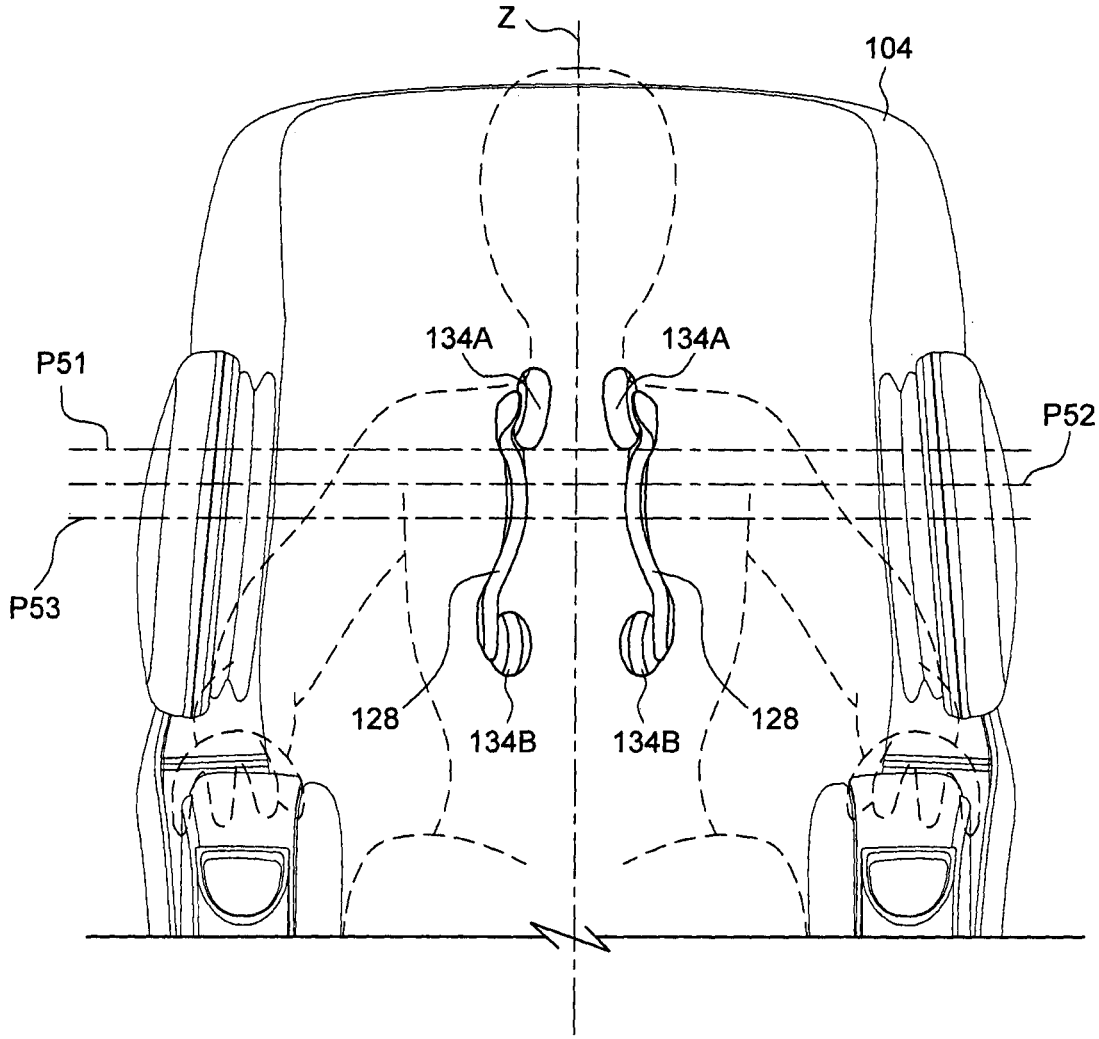

FIG. 17 is a flowchart illustrating method steps of another sequence of massage actions S5 implemented in the massage apparatus 100, and FIGS. 18A-18C are schematic views illustrating different positions of the massage arms 128 during the sequence of massage actions S5. In initial step 702, the massage arms 128 can be moved by the vertical driving unit 124 to a position P51 so that the upper contact members 134A can be placed adjacent to an upper neck area A4 as shown in FIG. 18A. The upper neck area A4 is higher than the upper shoulder area A1. When the massage arms 128 are in the position P51, the upper contact members 134A can be placed in the narrow state as shown in FIG. 4, and can slightly touch the skin surface.

In step 704, while the massage arms 128 are in the position P51, the forward positioning mechanism 123 can be actuated to cause a forward displacement X51 of the upper contact members 134A into the body. A pressure can be thereby applied and held for a time duration T51.

After the time duration T51 has lapsed, the forward positioning mechanism 123 in step 706 can be actuated to release the pressure and to cause another forward displacement X52 of the upper contact members 134A into the body. The forward displacement X52 can be equal to or differ from X51. In next step 708, while the forward displacement X52 of the upper contact members 134A is maintained, the vertical driving unit 124 can then drive the massage arms 128 to move downward along the lengthwise axis Z from the position P51 to a lower position P52 as shown in FIG. 18B. This can produce a push and roll massage action on the body.

In step 710, while the massage arms 128 are in the position P52, the forward positioning mechanism 123 can be operated to move the upper contact members 134A backward along the front-rear axis X, which can result in the lower contact members 134B to apply some pressure on the neck area. The vertical driving unit 124 in next step 712 then can drive the massage arms 128 to move downward along the lengthwise axis Z from the position P52 to a lower position P53 as shown in FIG. 18C. During this travel, the upper and lower contact members 134A and 134B can concurrently apply pressure on the body, which can produce another push and roll massage action.

In step 714, the massage arms 128 then can be actuated by the forward positioning mechanism 123 to retract the upper contact members 134A backward and release the pressure applied by the upper contact members 134A on the body.

In next step 716, the massage arms 128 then can be actuated so that the lower contact members 134B can perform a push and roll sequence on the back of the body similar to that of the upper contact members 134A described in steps 704 through 708.

In one embodiment, the sequence of massage actions S5 can take about one to about two minutes to complete. The push and roll sequences applied in the sequence of massage actions S5 can effectively relieve stress and pain around the neck and shoulder areas.

Advantages of the systems and methods described herein include the ability to apply short sequences of massage actions S1 through S5 that can effectively relieve stress and pain for different regions of the body such as the neck area, shoulder, lower back and thigh and hip areas. The sequences S1 through S5 can be implemented independently from one another, or in any desirable combinations. For example, certain embodiments can implement any one of the sequences S1 through S5 in the massage chair. Other embodiments can implement two, three, four or five of the sequences S1 through S5 in the massage chair. With the sequences of massage actions as described herein, a user can enjoy enhanced massage experience and obtain effective relief of muscular tension and pain.

Realizations of the systems and methods have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the inventions as defined in the claims that follow.

What is claimed is:

1. A method of driving a massage chair, wherein the massage chair includes a backrest, a seat, first and second massage arms assembled with the backrest, a rotary shaft formed through a common central axis of the first and second massage arms, a plurality of bottom airbags disposed in the seat, and a plurality of lateral airbags disposed at a left and a right side of the seat, the first massage arm having a first upper contact member and first lower contact member, the second massage arm having a second upper contact member and second lower contact member, the method comprising:

defining a coordinate system including a lengthwise axis extending along a length of the backrest, a transversal axis extending from a left toward a right side of the backrest, and a front-rear axis extending from a front toward a rear of the backrest;

configuring the massage chair so as to enable the first and second massage arms to move along the lengthwise axis;

configuring the massage chair so as to enable the first upper contact member, first lower contact member, second upper contact member, and second lower contact member to move along the front-rear axis;

configuring the massage chair so as to enable the first upper contact member and second upper contact member to move in such a way that a distance between the first upper contact member and the second upper contact member is greater than a distance between the first lower contact member and second lower contact member;

configuring the massage chair so as to enable the first upper contact member and second upper contact member to move in such a way that a distance between the first upper contact member and the second upper contact member is less than a distance between the first lower contact member and second lower contact member;

configuring the massage chair so as to enable the first upper contact member and second upper contact member to move in such a way that a distance between the first upper contact member and the second upper contact member is equal to a distance between the first lower contact member and second lower contact member;

configuring the massage chair so as to enable the first and second upper contact members to move away from one another while the first and second lower contact members move away from one another;

configuring the massage chair so as to enable the first and second upper contact members to move toward each other while the first and second lower contact members move toward each other;

driving the first and second massage arms to perform a first sequence of massage actions including:

moving the first and second massage arms along the lengthwise axis to a first position so that the first upper contact member, first lower contact member, second upper contact member, and second lower contact member are placed adjacent to an upper shoulder area;

while the first and second massage arms are in the first position, actuating the first and second massage arms so as to cause the first upper contact member, first lower contact member, second upper contact member, and second lower contact member to move forward along the front-rear axis and apply a single kneading action;

moving the first and second massage arms downward along the lengthwise axis from the first position to a second position, and concurrently inflating the bottom airbags;

while the first and second massage arms are in the second position, actuating the first and second massage arms so as to cause the first upper contact member, first lower contact member, second upper contact member, and second lower contact member to move forward along the front-rear axis and to apply another single kneading action;

positioning the first upper contact member, first lower contact member, second upper contact member, and second lower contact member in a narrow state, the narrow state being a state in which a distance between the first and second upper contact members are separated by a first upper distance and a distance between the first and second lower contact members are separated by a first lower distance;

positioning the first upper contact member, first lower contact member, second upper contact member, and second lower contact member from the narrow state to a medium state by moving the first and second upper contact members away from each other while also moving the first and second lower contact members away from each other, wherein the medium state is a state in which a distance between the first and second upper contact members are separated by a second upper distance and a distance between the first and second lower contact members are separated by a second lower distance, the second upper distance being greater than the first upper distance, the second lower distance being greater than the first lower distance; and positioning the first upper contact member, first lower contact member, second upper contact member, and second lower contact member from the medium state to a wide state by moving the first and second upper contact members away from each other and while also moving the first and second lower contact members toward each other, wherein the wide state is a state in which a distance between the first and second upper contact members are separated by a third upper distance and a distance between the first and second lower contact members are separated by a third lower distance, the third upper distance being greater than the second upper distance, the third lower distance being less than the second lower distance.

2. The method according to claim 1, wherein the first sequence of massage actions further includes:

while keeping the bottom airbags inflated, moving the first and second massage arms downward along the lengthwise axis from the second position to a third position; and while the first and second massage arms are in the third position, actuating the first and second massage arms so as to cause the first upper contact member, first lower contact member, second upper contact member, and second lower contact member to apply three additional cycles of kneading actions.

3. The method according to claim 1, further including driving the first and second massage arms to perform a second sequence of massage actions including:

moving the first and second massage arms along the lengthwise axis to a third position so that the first upper contact member, first lower contact member, second upper contact member, and second lower contact member are placed adjacent to the upper shoulder area, wherein the first upper contact member, first lower contact member, second upper contact member, and second lower contact member in the third position are spaced apart from each other by a first distance along the transversal axis;

while the first and second massage arms are in the third position, inflating the bottom airbags in the seat, and actuating the first and second massage arms to cause a forward displacement of the first upper contact member, first lower contact member, second upper contact member, and second lower contact member along the front-rear axis for applying a pressure for a first time duration, and to apply a tapping action after the lapse of the first time duration;

moving the first and second massage arms downward along the lengthwise axis from the third position to a fourth position, and actuating the first and second massage arms so that the first upper contact member, first lower contact member, second upper contact member, and second lower contact member in the fourth position are spaced apart from each other by a second distance along the transversal axis that is greater than the first distance; and while the first and second massage arms are in the fourth position, applying a pressure through the first upper contact member, first lower contact member, second upper contact member, and second lower contact member for a second time duration, and actuating the first and second massage arms to apply another tapping action after the lapse of the second time duration.

4. The method according to claim 3, wherein the second sequence of massage actions further includes:

moving the first and second massage arms downward along the lengthwise axis from the fourth position to a fifth position, and actuating the first and second massage arms so that the first upper contact member, first lower contact member, second upper contact member, and second lower contact member in the fifth position are spaced apart from each other by a third distance along the transversal axis that is greater than the second distance;

while the first and second massage arms are in the fifth position, keeping the bottom airbags inflated, holding the forward displacement of the first upper contact member, first lower contact member, second upper contact member, and second lower contact member for applying a pressure for a third time duration, and actuating the first and second massage arms to apply another tapping action after the lapse of the third time duration.

5. The method according to claim 3, wherein the bottom airbags are kept in an inflated state during the application of the pressure in the second time duration.

6. The method according to claim 3, further including driving the first and second massage arms to perform a third sequence of massage actions including:

moving the first and second massage arms along the lengthwise axis to a third position so that the first upper contact member, first lower contact member, second upper contact member, and second lower contact member are placed adjacent to a lower waist area; and while the first and second massage arms are in the third position, actuating the first and second massage arms so as to cause the first upper contact member, first lower contact member, second upper contact member, and second lower contact member to repeat two or more times a push and hold sequence including moving the first upper contact member, first lower contact member, second upper contact member, and second lower contact member forward along the front-rear axis for applying a pressure, and holding the pressure for a time duration.

7. The method according to claim 6, wherein the third sequence of massage actions further includes:

while the first and second massage arms are in the third position, actuating the first and second massage arms so as to cause the first upper contact member, first lower contact member, second upper contact member, and second lower contact member to apply a tapping action immediately after each of the push and hold sequence.

8. The method according to claim 6, wherein the push and hold sequence is repeated with a different forward displacement of the first upper contact member, first lower contact member, second upper contact member, and second lower contact member along the front-rear axis, and a different time duration of holding the pressure.

9. The method according to claim 6, wherein the third sequence of massage actions further includes:

moving the first and second massage arms along the lengthwise axis from the third position to a fourth position; and while the first and second massage arms are in the fourth position, actuating the first and second massage arms so as to cause the first upper contact member, first lower contact member, second upper contact member, and second lower contact member to repeat two or more times the push and hold sequence.

10. The method according to claim 6, further including driving the first and second massage arms to perform a fourth sequence of massage actions including:

inflating the lateral airbags for a first time duration; and after the lapse of the first time duration, inflating the bottom airbags for a second time duration.

11. The method according to claim 10, further including driving the first and second massage arms to perform a fifth sequence of massage actions including:

moving the first and second massage arms along the lengthwise axis to a third position so that the first upper contact member, first lower contact member, second upper contact member, and second lower contact member are placed adjacent to an upper neck area;

while the first and second massage arms are in the third position, actuating the first and second massage arms so as to cause a forward displacement of the first upper contact member, first lower contact member, second upper contact member, and second lower contact member along the front-rear axis; and moving the first and second massage arms along the lengthwise axis from the third position downward to a fourth position while keeping the forward displacement of the first upper contact member, first lower contact member, second upper contact member, and second lower contact member.

12. The method according to claim 11, wherein before effecting the forward displacement of the first upper contact member, first lower contact member, second upper contact member, and second lower contact member, the fifth sequence of massage actions further includes actuating the first and second massage arms so as to cause the first upper contact member, first lower contact member, second upper contact member, and second lower contact member to move forward along the front-rear axis for applying a pressure for a time duration, while the first and second massage arms are in the third position.

* * * * *